US006626119B2

(12) United States Patent
Wilton

(10) Patent No.: US 6,626,119 B2
(45) Date of Patent: Sep. 30, 2003

(54) DISPLAY KIT AND METHOD OF ASSEMBLYING SAME

(76) Inventor: Paul V. Wilton, 2932 Via Loma Vista, Escondido, CA (US) 92029

( * ) Notice: Subject to any disclaimer, the term of this patent is extended or adjusted under 35 U.S.C. 154(b) by 0 days.

(21) Appl. No.: 09/782,760

(22) Filed: Feb. 12, 2001

(65) Prior Publication Data

US 2002/0108542 A1 Aug. 15, 2002

(51) Int. Cl.[7] ..... A47B 3/02
(52) U.S. Cl. ..... 108/118
(58) Field of Search ..... 108/118, 115, 108/119, 35, 36, 90

(56) References Cited

U.S. PATENT DOCUMENTS 445,159 A * 1/1891 Bresnan
1,185,568 A * 5/1916 Zeunert
1,833,177 A * 11/1931 Rice
2,644,590 A * 7/1953 Baxter
3,837,719 A * 9/1974 Barron
5,315,935 A * 5/1994 Weisenfels
5,645,259 A * 7/1997 Chen
5,865,127 A * 2/1999 Carter
6,073,894 A * 7/2000 Chen
6,158,361 A * 12/2000 Zheng et al.
6,182,724 B1 * 2/2001 Chou et al.

* cited by examiner

*Primary Examiner*—Jose V. Chen
(74) *Attorney, Agent, or Firm*—Jerry R. Potts

(57) ABSTRACT

A display kit and display arrangement includes a collapsible pedestal base unit, pedestal top and collapsible merchandise display case that can be easily transported in a lightweight carrying case and assembled and disassembled in seconds in accordance novel methods of assembly and disassembly without the use of hardware or hardware mounting tools.

28 Claims, 13 Drawing Sheets

DISPLAY KIT AND METHOD OF ASSEMBLYING SAME

TECHNICAL FIELD

The present invention relates in general to a display arrangement and display kit for supporting and displaying various types and kinds of objects as well as a method for assembling the display arrangement. The invention more particularly, relates to a collapsible display table and merchandise display case and method of assembly that enables a user to assemble the display arrangement in a fast and convenient manner without the use of hardware or hardware mounting tools.

BACKGROUND

Display cases for exhibiting jewelry, coins and other types and kinds of merchandise have existed in a variety of forms. The majority, if not all of such display cases, for the most part requires extensive time for assembly requiring both hardware and hardware mounting tools to complete the assembly process. For example reference may be made to the following U.S. Pat. Nos. 3,866,549; 3,875,873; 4,519,318; 4,643,103; 4,848,245; 4,905,612; 5,086,711; 5,094,176; 5,322,022; 5,377,601; 5,794,546; 5,865,127; 6,079,338; and 6,164,217.

While such display cases and tables may have been satisfactory for certain situations, they generally could not be easily assembled in a fast and convenient manner without the use of hardware and hardware mounting tools nor could they be easily transported or shipped from display site to display site.

Therefore, it would be highly desirable to have a new and improved display arrangement and display kit, which is easily transportable and that can be assembled by a user in a fast and convenient manner without the use of hardware and hardware mounting tools.

DISCLOSURE OF INVENTION

In one embodiment a display kit includes a display arrangement having a collapsible pedestal base unit, an intermediate pedestal shelf, and a pedestal top. The method of assembling the kit includes expanding the pedestal base unit to its full lateral expansion configuration, expanding the laterally expanded unit to a fully expanded upright configuration, bracing the fully expanded pedestal base unit in a first stabilized position, mounting the pedestal top to the top of the stabilized pedestal base unit, bracing the stabilized pedestal base unit in a final stabilized position, securing the pedestal top to the pedestal base unit and mounting the pedestal intermediate shelf onto the stabilized pedestal base unit.

In another embodiment a display kit includes a display arrangement having a collapsible pedestal base unit, a pedestal top, a set of pedestal base unit skirts, a collapsible merchandise display case, and a transportation carrying unit. The method of assembling the kit includes removing the component parts of the display arrangement from the transportation carrying unit, expanding the pedestal base unit from its collapsed configuration to a full upright pedestal base unit, fixing in place two sides of the expanded pedestal base, mounting the pedestal top to the pedestal base unit, fixing in place the other two sides of the expanded pedestal base unit to secure the pedestal top to the pedestal base unit, attaching the display case frame members to the pedestal top, mounting the display case transparent members and access door in the assembled display case frame, and mounting the skirts to the fully expanded pedestal base unit.

In yet another embodiment a display kit includes a display arrangement having a pair of collapsible pedestal base units, a pedestal top, and an object display case. The method of assembling the kit includes expanding each individual pedestal base unit from a collapsed configuration to a full upright standing configuration, partially anchoring in a partially stabilized position each of the expanded pedestal base units, mounting the pedestal top between the pedestal base units, anchoring the pedestal top to each of the expanded pedestal base unit to filly stabilize the display arrangement, and attaching removably the display case to the top of the pedestal top.

In still yet another embodiment a display kit includes a display arrangement having a double wide collapsible pedestal base unit, a pedestal top and an object display case. The method of assembling the kit includes expanding the double wide collapsible pedestal base unit from a collapsed configuration to a full upright standing configuration with a plurality of adjustable supporting legs, locking the expanded pedestal base unit into a secure ridged configuration, mounting and securing the pedestal top to the double wide collapsible pedestal base unit and attaching the display case to the top of the pedestal top.

In still yet another embodiment, a display kit includes a display arrangement having a collapsible pedestal base unit, a pedestal top, at least a pair of stackable merchandise or object display cases, an attachable lighting system, and a double wide shipping or transportation case. The method of assembling the kit includes removing from the display components from the shipping case, expanding the collapsible pedestal base unit from a collapsed configuration to an upstanding configuration with a plurality of adjustable supporting legs and cross legged members, moving each of the cross legged members to their full expanded positions to help secure the pedestal base unit in its full upright standing position, mounting the pedestal top to the upper ends of the plurality of adjustable supporting legs, securing the pedestal top to the pedestal base, adjusting the support legs of the pedestal base unit to align the pedestal top in a substantially horizontal plane, mounting the bottom frame for the bottom one of the stackable merchandise cases to the pedestal top, mounting at least three transparent wall members of the bottom merchandise case between the bottom frame members, mounting a pair of lockable doors between pairs of the bottom frame members, mounting a top glass support wall to the top of the bottom frame members, mounting the top frame of the top one of the merchandise cases to the top support wall, mounting a pair of short square transparent wall members between pairs of front wall frame members, mounting a set of angled transparent wall members between the side top frame members, mounting a top glass observation wall to the top of the top frame members, and mounting a pair of lockable doors between pairs of back top frame members.

BRIEF DESCRIPTION OF THE DRAWINGS

The above mentioned features of the invention and the manner of attaining them will become apparent, and the invention itself will be best understood by reference to the following description of the embodiments of the invention in conjunction with the accompanying drawings wherein.

BEST MODE FOR CARRYING OUT THE INVENTION

The display kit and display arrangement of the present invention as described herein include numerous variations and configurations. For easy in understanding the various variations and configurations, a simple outline is provided as follows:

A. A Display Kit and Display Arrangement Having An Intermediate Storage Shelf.

B. A Display Kit and Display Arrangement Having Skirts and A Box-Like Display Case.

C. A Display Kit and Display Arrangement Having Bridged Pedestal Base Units and Pedestal Display Top with a Centered Square Display Case.

D. A Display Kit and Double Wide Display Arrangement Having an Angled Display Case Including a Low Voltage Lighting Strip.

E. A Display Kit and Double Wide Display Arrangement Having Stacked Display Cases, Squared and Angled, with the Top Angled Display Case Including a Battery Powered Lighting Strip.

Each individual embodiment of the present invention will now be described in sufficient detail to enable one skilled in the art to practice and use the described embodiments of the present invention.

A. A Display Kit and Display Arrangement Having An Intermediate Storage Shelf.

Figure 1:
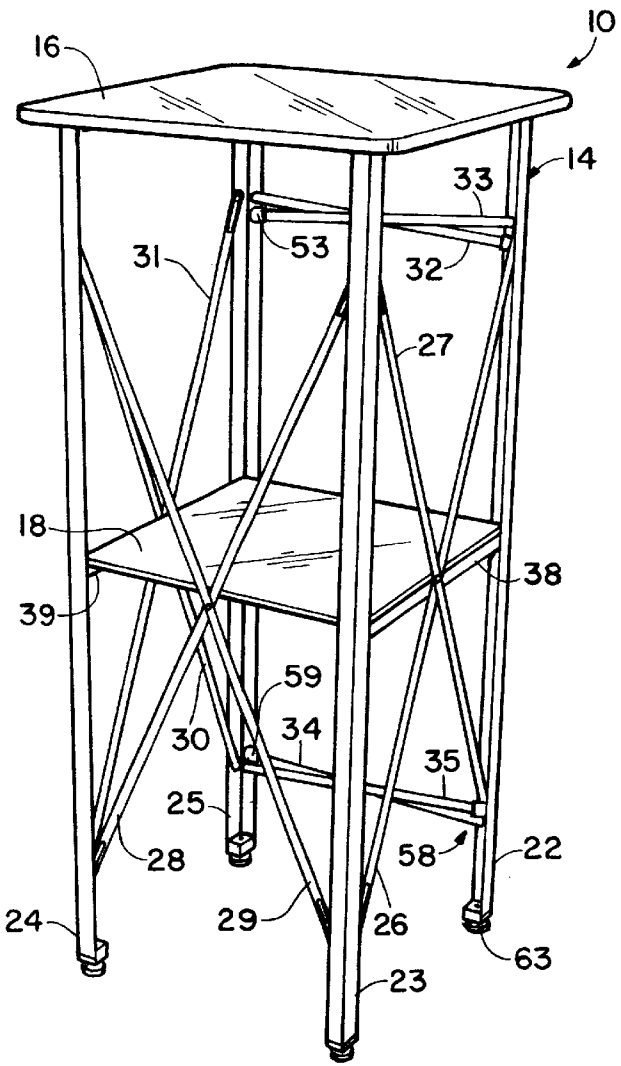
FIG. 1 is a pictorial view illustrating operative elements of a display arrangement kit, which is constructed in accordance with the present invention.
Figure 19:
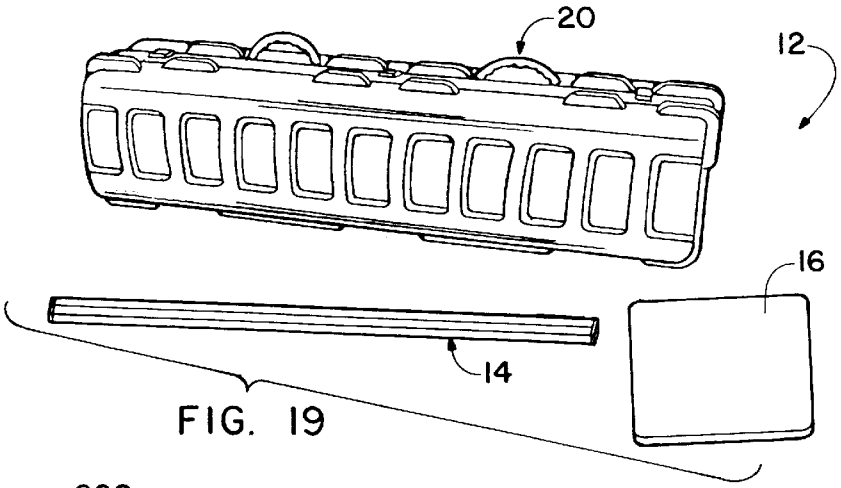
FIG. 19 is a greatly reduced pictorial view of the display kit of FIG. 1, illustrating the operative elements and a single wide carrying case.

Referring now to the drawings and more particularly to FIGS. 1 and 19 thereof, there is illustrated a display arrangement 10 (FIG. 1) and display kit 12 (FIG. 19) that is constructed in accordance with the present invention. The display arrangement 10 is lightweight, collapsible and in accordance with a novel method of assembly, the display arrangement 10 is easily set-up or assembled without the use of mounting hardware or id mounting hardware tools as will be explained hereinafter in greater detail.

Considering now the display arrangement 10 and display kit 12 in greater detail with reference to FIGS. 1 and 19, the display kit 12 includes a collapsible support entity or pedestal base unit 14, a ridged planar primary supporting surface or pedestal top 16, a ridged planar secondary supporting surface or intermediate shelf unit 18 and a single wide transportation unit or storage case 20 as best seen in FIG. 19. The collapsible pedestal base unit 14, pedestal top 16, and intermediate shelf unit 18 are stored in the storage case 20 when not in use.

When the pedestal base unit 14 and pedestal top 16 and intermediate shelf unit 18 are removed from the storage case 20, they are easily assembled together without the use of hardware or hardware mounting tools in accordance with the novel method of assembly of the present invention. As best seen in FIG. 1, when the combined pedestal base unit 14, pedestal top 16, and intermediate shelf unit 18 are assembled together as a single unit they provide a stylish, attractive table design or display arrangement 10 that can be utilized in a home or office setting.

Figure 15A:
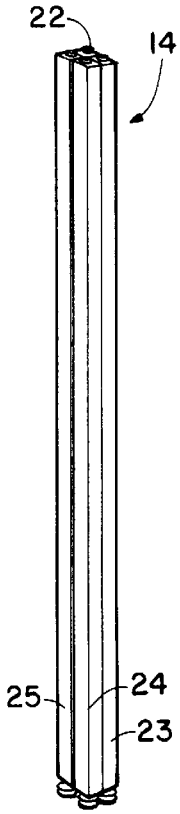
FIGS. 15A–E illustrate the steps of assembling the display arrangement kit of FIG. 1.
Figure 17:
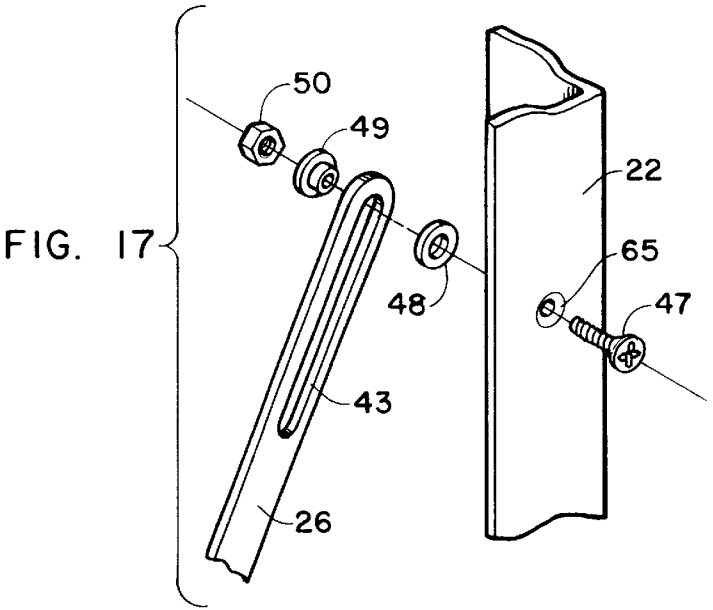
FIG. 17 is an enlarged fragmentary pictorial view of the interconnection between a support leg member and a slotted cross-legged brace member of FIG. 1.
Figure 18:
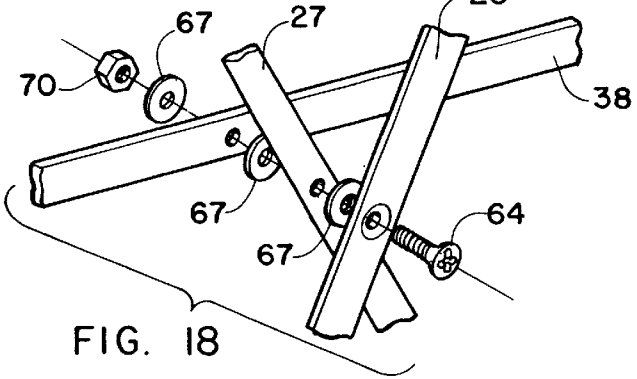
FIG. 18 is an enlarged fragmentary pictorial view of the interconnection between the slotted cross-legged brace member of FIG. 1.

Considering now the pedestal base unit 14 in greater detail with reference to FIGS. 1, 17, and 18, the pedestal base unit 14 generally includes a set of elongated L-shaped support legs, such as support legs 22–25 that are interconnected by a pair sets of elongated slotted cross legged brace members, such as slotted cross legged brace member pairs 26–27, 28–29, and 30–31 respectively. The lower distal ends of the support legs 22–25 are each capped with a foot levelers or height adjusters, such as a height adjuster 63. The height adjuster 63 helps to facilitate leveling the pedestal base unit 14 when it is placed on an uneven supporting surface. As will be explained hereinafter in greater detail, the pedestal base unit 14 is collapsible into an elongated bar like configuration for easy storage and transportation as best seen in FIG. 15A.

The pedestal base unit 14 further includes a pair of pedestal brace members 38 and 39 that cooperate with the support legs 22–25 and the cross legged brace member pairs 26–27, 28–29 and 30–31 to help stabilize the pedestal base unit 14 when it is fully expanded. The pedestal brace members 38 and 39 are mounted rotatably to the set of cross legged brace member pairs 26–27 and 30–31 respectively at their pivot points and when rotated into SL engagement with the support legs they also function as intermediate shelf supports or brackets as will be explained hereinafter in greater detail.

The distal ends of the pedestal brace members 38 and 39 are each capped with rubber stops, such as a rubber stop 40 (FIG. 15), which create interference with the support legs 22–23 and 24–25 when the respective brace members 38 and 39 are rotated into engagement with their associated support legs. The interference is sufficient to cause a friction tight fit that stabilizes or locks the support leg pairs 22–23 and 24–25, but not such a friction tight fit that the brace members 38 and 39 can not be easily disengaged from locking their respective support legs in such stabilized positions.

The cross-legged pair members, such as the cross-legged pair members 26–27 is secured at about their center longitudinal axes to facilitate a scissor-like or accordion-like action when pulled or pushed toward one another. For example, cross-legged member pair 26–27 is secured pivotally together at their respective longitudinal centers by a bolt 64, a set of washers 67 and a lock nut 70 as best seen in FIG. 18. It should be noted however, that the mounting of the cross-legged member pairs pivotally together is only done once, which is at the manufacturing stage only. Thus there is no need to affix the member pairs together in the normal field assembly process of the present invention.

Each of the cross-legged member pairs is also mounted slidably between a pair of the support legs. In this regard, in order to facilitate slideable mounting, each pair of the cross-legged members, such as cross-legged members 26–27 include at their distal ends an elongated slot or hole, such as the slot 43. As the manner in which any one of the cross-legged members is slidably mounted to a support leg in a similar manner, only the mounting arrangement for the cross-legged member 26 will be described in greater detail with reference to the support leg 22.

Considering now the support leg 22 in greater detail, each support leg, such as the support leg 22 is L-shaped and includes a pair of spaced apart counter bore drill holes, such as the hole 65, that are disposed near the upper and lower distal ends of the support leg 22. The hole pairs are disposed spaced from the distal ends of each supporting leg a sufficient distance in order to permit an associated cross legged member, such as the cross-legged member 26, to slide either upwardly or downwardly along or adjacent an inside wall of its corresponding support leg without extending beyond the distal end of the corresponding supporting leg.

During the manufacturing phase only, the cross-legged member 26 is slidably mounted to a top portion of support leg 22 by a bolt 47 that is secured in the hole 65 and the slot 43 by a self locking nut 50. A pair of nylon washers 48–49 is disposed on bolt mounted washers 48–49 at about the slot 43 on opposite sides of the cross-legged member 26 adjacent to support leg 22. In this manner, the orientation between the hole 65 on support leg 22 and the slot 43 on the cross-legged member 26 when the cross legged member 26 is mounted to the leg 22 permits the cross legged member 26 to slide on the screw 47 between the ends of the slot 43 which act as stops to prevent further a upwardly or downwardly sliding action by the cross legged member 26 relative to support leg 22. The other end of the cross-legged member 26 is slidably mounted to a bottom portion of support leg 23 in a similar manner with similar mounting hardware during the manufacturing phase of construction.

From the foregoing, it should be understood by those skilled in the art that when the pair of support legs 22–23 are pulled toward one another, the cross legged member 26 rides upwardly on or adjacent to the inside wall of leg 22 and downwardly on or adjacent to the inside wall of leg 23 a sufficient distance to permit the pair of support legs 22–23 to scissors together inside the support legs to form a tight bar-like configuration as best seen in FIG. 15A.

Conversely, when the pair of support legs 22–23 are pulled away from one another, the cross legged member 26 rides downwardly on or adjacent the inside wall of leg 22 and upwardly on or adjacent to the inside wall of leg 23 to permit the full expansion of the pedestal support base 14 along its lateral axis.

It should therefore be understood by those skilled in the art, that since the cross legged member mounting arrangements for the remaining cross legged members is substantially the same as described for cross leg member 26, the collapsing action described for the support legs 22–23, will be duplicated by the opposing support legs 24–25 when pulled or pushed toward one another to collapse the pedestal base unit 14 in the longitudinal direction.

In like manner, when the support legs 23–24 are pulled or pushed toward one another a similar collapsing action takes place in a lateral or perpendicular direction to the longitudinal direction to cause the pedestal base unit 14 to collapse into an elongated bar-like shape. Thus, for example a fully expanded pedestal base unit with dimensions of about 15-inches by 15-inches by 36-inches high collapses into a two-inch by two-inch bar thirty-six inches in length.

Figure 13:
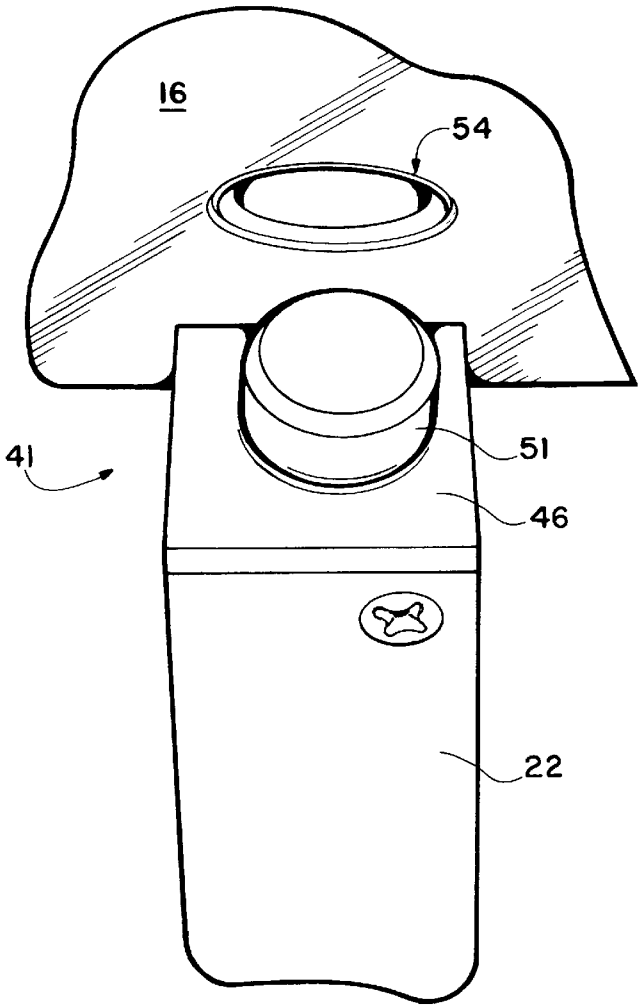
FIG. 13 is an enlarged fragmentary pictorial view of the top of one of the support leg members of FIG. 1, illustrating the details of positive location of the pedestal top to the pedestal base unit.
Figure 11:
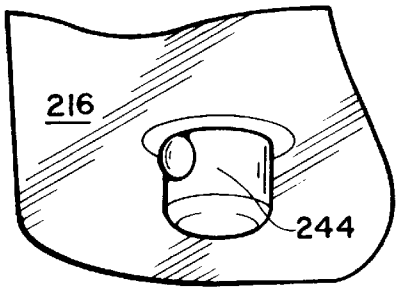
FIG. 11 is an enlarged fragmentary pictorial view of the underside of the pedestal top of FIG. 2, illustrating a frame member removably mounted within the pedestal top.

As will be explained hereinafter in greater detail, the upper distal end of each of the support legs 22–25 are capped with a bottom pedestal locator, such as a bottom pedestal locator 41 (FIG. 13). The pedestal locator 41 includes a base member 46 and an integrally connected uprising boss or top locator member 51 having a round mushroom like shape.

The pedestal locator 41 is secured in a conventional manner by a mounting screw 42 to a corresponding one of the support legs, such as the support leg 22, during the manufacturing phase only. The pedestal locators, such as the pedestal locator 41, provide positive mounting and align between the top of the pedestal base unit 14 support legs, such as the support leg 22, and the bottom of the pedestal top 16 as will be explained hereinafter in greater detail.

As best seen in FIGS. 1 and 15, the pedestal base unit 14 also includes a set of upper cross-legged locking or bow tie brace members 32–33 and a set of lower bow tie brace members 34–35 that are pivotally connected in a slightly offset manner from their respective centers. More particularly, each of the bow tie brace member pairs, such as the bow tie brace member pair 32–33 is secured pivotally together in a slightly offset manner. The lower set of bow tie brace member pair 34–35 is secured together in a similar manner.

Respective ones of the upper and lower securing members 32 and 34 and 33 and 35 are also pivotally mounted to opposite ones of the support legs 25 and 22 respectively. More particularly for example, one end of securing member 32 is pivotally mounted to support leg 25 and one end of securing member 33 is pivotally mounted to support leg 22. The opposite ends of the securing members 32 and 33 respectively are free and thus, are able to be moved toward or away from each other about their offset pivot points about screw 55. In this arrangement, each one of the free ends of the securing members 32–33 and 34–35 respectively may be rotated into engagement with an opposing support leg to provide an outwardly directed cam action that locks or secure the pedestal top 16 to the supporting legs 22–25 respectively as will be explained hereinafter in greater detail.

Rubber stops, such as the stops 52–53 and 58–59 are disposed on the free ends of the securing members 32–33 and 34–35 respectively. The rubber stops 52–53 and 58–59 permit the bow-tie brace members to be moved into friction tight engagement with the support legs 22 and 25 respectively. In this manner a positive locking effect is achieved between the support legs 22–25 of the pedestal base unit 14 and the pedestal top 16.

Once the pedestal base unit 14 and pedestal top 16 are locked or secured in place, the intermediate shelf 18 is inserted into or within the open interior space of the pedestal base unit 14 between support legs 22 and 25 and then aligned with the support legs 22–25 in a perpendicular manner bringing the shelf 18 to rest on respective ones of the pedestal brace members 38 and 39. In this manner the intermediate shelf 18 is supported from below on the pedestal brace members 38 and 39, in a stable secure manner to provide the secondary supporting surface for the display arrangement 10.

Considering now the pedestal top 16 in greater detail with reference to FIGS. 1 and 13, the pedestal top 16 is a ridged planar supporting surface having an overall square shape with smooth rounded corners and edges. The underside of the pedestal top 16 is milled out to provide a set of four locating notches, such as a locating notch 54, each having a generally circular shape. The locating notches are disposed adjacent to respective one of the corners of the pedestal top 16. Each locating notch, such as the notch 54 is dimensioned to receive in a friction tight removable fit a corresponding one of the bottom pedestal locators, such as the bottom pedestal locator 51 as best seen in FIG. 13. In short then, during use, the pedestal locators and locating notches enable a user quickly align and mount the pedestal top 16 to the pedestal base unit 14 or conversely quickly remove the pedestal top 16 from the pedestal base unit 14, whichever the case may be relative to assembly or disassembly of display arrangement 10.

From the foregoing, those skilled in the art will understand that the display arrangement 10 functions as either as an attractive table or as a tabletop display stand with an intermediate shelf storage area.

Figure 15B:
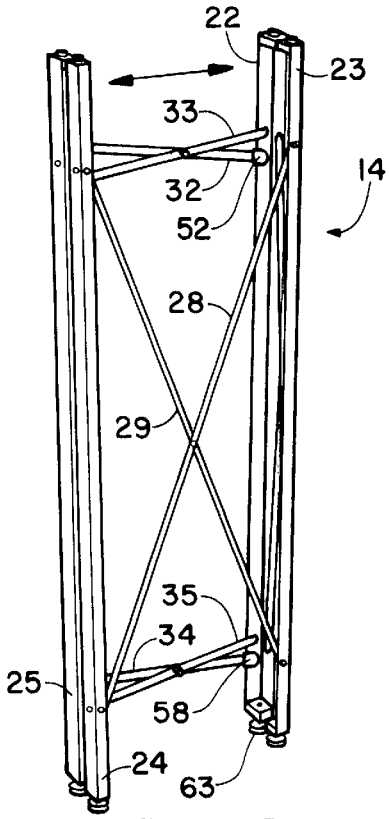
Figure 15C:
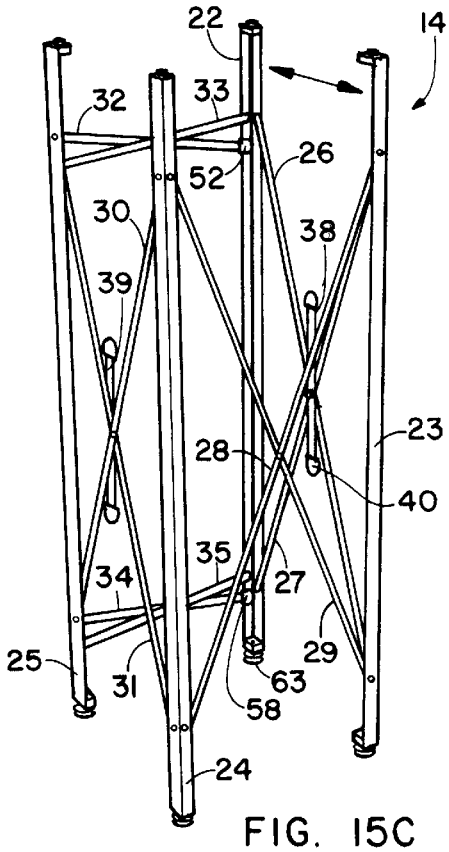

Considering now the method of assembling the display kit 12 to provide the display arrangement 10 in greater detail the collapsed pedestal base unit 14 is first grasped by all four-support legs 22–25 as best seen in FIG. 15A. The lateral support leg pairs, such as legs 22–23 and 24–25, are then expanded or pulled away from one another in a first or lateral W direction until the lateral cross-legged members 26–27 and bow tie brace members 32–35 are fully extended as best seen in FIG. 15B. The user then releases the support legs 23–24 and pushes the longitudinal support leg pairs, such as legs 23–24 and 22–25, away from each other until the longitudinal cross-legged members 26–27 and 30–31 respectively, are fully extended as best seen in FIG. 15C. This last mentioned expansion action is a snapping action that brings the base pedestal unit 14 into a substantially fully expanded configuration allowing the user to place the unit 12 on the ground or floor in a substantially secure upright position as seen in FIG. 15C.

Figure 15D:
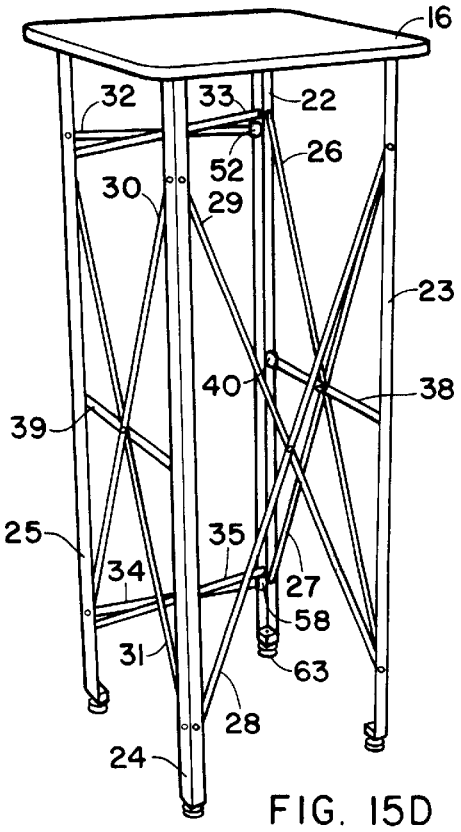

Next, as best seen in FIG. 15D, the user rotates the brace member 38 into friction tight engagement with the support legs 22–23 to stabilize the right side of the pedestal base unit 14. The user then rotates the brace member 39 into friction tight engagement with the support legs 24–25 to stabilize the left side of the pedestal base unit 14.

With the pedestal base unit 14 in a substantially stabilized configuration, the user then aligns the notched locators, such as the locating notch 54, disposed on the underside of the pedestal top 16, with the pedestal locators, such as the pedestal locator 51, disposed on the upper distal ends of respective ones of the support legs 22–25, and presses the locators into their corresponding locator notches securing the pedestal top 16 to the pedestal base 14 in a friction tight easily removable fit.

To secure or lock the pedestal top 16 to the pedestal base 14, the user presses the free end of bow tie member 32 into friction tight engagement with the interior wall of support leg 22 and the free end of cross legged securing member 33 into friction tight engagement with the interior wall of support leg 25 to cam the pedestal base unit 14 and the pedestal top 16 into a ridged secure upright stable configuration. This process is then repeated for the bow tie brace members 34–35 respectively to further stabilize the pedestal base unit 14 and the pedestal top 16 as best seen in FIG. 15D.

It should be understood by those skilled in the art that the combination of the brace supports 38–39 and the bow-tie supports cooperate with the support legs 22–25 and cross legged member pairs 26–27, 28–29, and 30–31 to completely stabilize the pedestal base unit 14 and the pedestal top 16 so as to provide a sturdy structure that supports objects in a safe and secure manner.

Figure 15E:
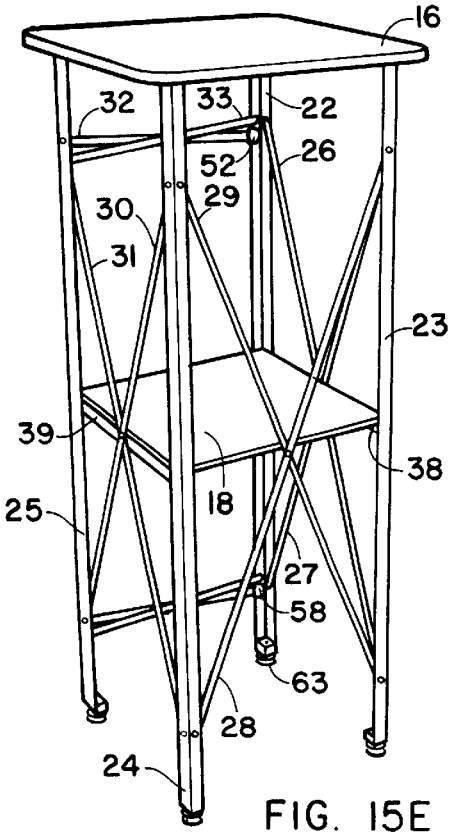

As a final step of assembly as best seen in FIG. 15E, the user places the intermediate shelf 18 into the interior of the pedestal base unit 14 and aligns the shelf 18 in a horizontal plane substantially parallel to the pedestal top 16 and allows the shelf to rest on the pedestal brace members 38 and 39 respectively.

In order to disassembly the display arrangement 10, a user follows a reverse process. That is, the user first removes the intermediate shelf 18 from the interior of the pedestal base unit 14. The user then disengages the bow tie securing members 32–33 and 34–35 from their friction tight engagement with their corresponding support legs.

Next, the user removes the pedestal top 16 from engagement with the pedestal locators, such as the bottom pedestal top locator 51, placing the pedestal top 16 in the storage unit 20.

The user, then in preparation of collapsing the pedestal base unit 14, rotates the brace members 38 and 39 to positions that are parallel with the support legs 22–25 as best seen in FIG. 15C.

The user then collapses the pedestal base unit 14 by pulling the lateral support leg pairs 22–23 and 25–24 towards one another and pulling the longitudinal support legs 23–24 and 22–25 towards one another permitting the pedestal base unit 14 to be collapsed into a hollow elongated bar like configuration, where all of the slotted cross-legged brace members 26–31, the brace members 38–39 and the cross-legged securing members 32–33 are disposed within the interior of the collapsed pedestal base unit 14. In this manner, there is little dead space within the interior of the collapse pedestal base unit 14.

Figure 14:
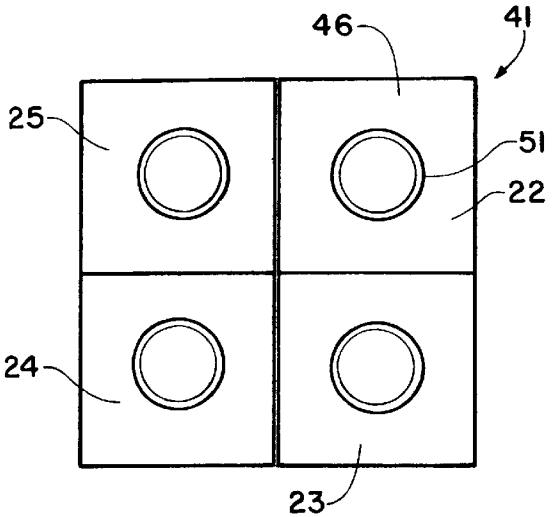
FIG. 14 is an end view of the pedestal base unit of FIG. 1 in a collapsed configuration, illustrating the lack of dead space within the collapsed unit.

As best seen in FIGS. 14 and 15A, the outside surface of the collapsed pedestal base unit 14 is a series of smooth planar surfaces that can be stored in a carrying bag (not shown) and then placed in the storage unit 20 with the pedestal top 16 and the intermediate shelf 18 for convenient storage or transportation whichever the case may be.

B. A Display Kit and Display Arrangement Having Skirts and An Angled Display Case.

Figure 2:
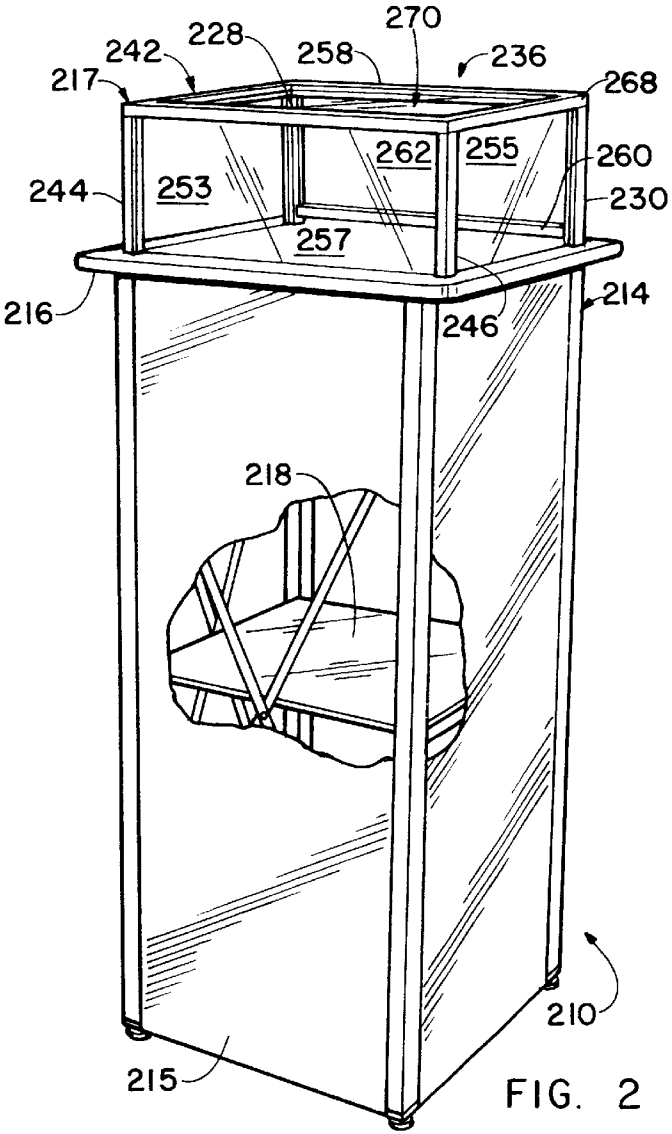
FIG. 2 is a pictorial view illustrating the operative elements of another display arrangement kit, which is constructed in accordance with the present invention.
Figure 20:
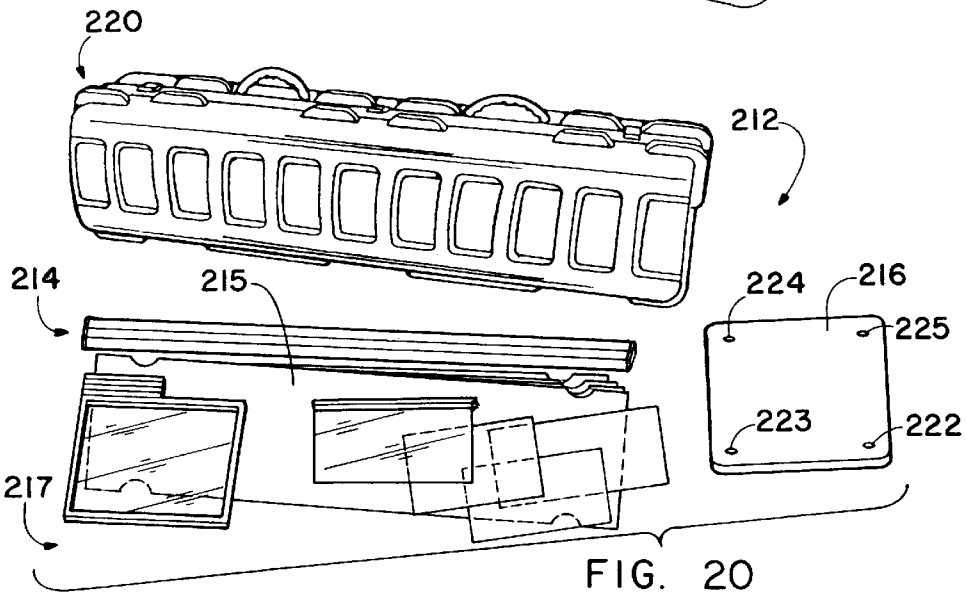
FIG. 20 is a greatly reduced pictorial view of the display kit of FIG. 2, illustrating the operative elements and a singlewide carrying.

Referring now to the drawings and more particularly to FIGS. 2 and 20 thereof there is illustrated another display arrangement 210 and display kit 212 that is constructed in accordance with the present invention. The display arrangement 210 is lightweight, collapsible and in accordance with a novel method of assembly, the display arrangement 210 is easily set-up or assembled without the use of mounting hardware or mounting hardware tools as will be explained hereinafter in greater detail.

Considering now the display arrangement 210 and display kit 212 in greater detail with reference to FIGS. 2 and 20, the display kit 212 includes a collapsible pedestal base unit 214, a set of pedestal panels, such as a pedestal panel 215, a pedestal top 216, a collapsible merchandise or object display case 217, an intermediate shelf unit 218 and a single wide transportation case 220 as best seen in FIG. 20. The collapsible pedestal base unit 214, set of pedestal panels, such as the pedestal skirt 215, pedestal top 216, collapsible display case 217 and intermediate shelf unit 218 are stored in the storage case 220 when not in use. When the pedestal base unit 214, pedestal skirts, such as pedestal skirt 215, pedestal top 216, collapsible display case 217 and intermediate shelf unit 218 are removed from the storage case 220, they are easily assembled together without the use of hardware or hardware mounting tools in accordance with the novel method of assembly of the present invention. When assembled, the resulting display arrangement 212 provides a stylish, attractive merchandise display stand design that can be easily assembled and disassembled to facilitate transporting the display arrangement 212 from trade show to trade in a fast and convenient manner.

As the pedestal base unit 214, intermediate shelf 218, and transportation case 220 are substantially similar to pedestal base unit 14, intermediate shelf 18, and transportation case 20 they will not be described hereinafter in greater detail Considering now the display kit 212 in greater detail, the display kit 212 includes a pedestal top 216 that is substantially similar to pedestal top 16 except that the pedestal top 216 further includes a front set of dowel holes 222–223 and a rear set of dowel holes 224–225. The dowel holes 222–225 extend completely through the pedestal top 216 and are disposed adjacent corresponding one of the locating notches (not shown since they are substantial similar to the locating notch 54 previously described) disposed on the underside of the pedestal top 216. As will be described hereinafter in greater detail, the front and rear dowel holes 222–225 enable the collapsible display case 217 to be removably mounted to the topside of the pedestal top 216 in a fast and convenient manner.

Considering now the pedestal skirt 215, the display arrangement 210 includes front and side pedestal skirts, such as the pedestal skirt 215, to provide the display arrangement with a stand like appearance. The rear of the pedestal base 214 unit remains open without a skirt providing access to the intermediate shelf 218. The skits are made of colored plastic or other suitable material to provide a smooth outer wall appearance. The pedestal skirts are notched as best seen in FIG. 20 and are held in place by the cross legged mounting hardware, such as the bolt 47, washer 48, and nut 50, as well as the L-shaped frames of the respective ones of the support legs forming part of the pedestal base unit 214.

Considering now the collapsible object display case 217 in greater detail with reference to FIG. 2, the collapsible display case 217 has a general box-like configuration and generally includes a left hand access door-receiving member 228 and a right hand access door-receiving member 230 that are adapted to be removably mounted in the dowel holes 224 and 225 respectively.

Each access door receiving member, such as the right hand access door receiving member 230, is milled with a glass-receiving slot, such as a glass-receiving slot 233, that extends along the entire longitudinal length of the front facing surface of the access door-receiving member relative to when the receiving member 230 is mounted on the pedestal top 216.

In addition, each access door receiving member, such as the right hand access door receiving member 230 includes an upper detent 232 and a lower detent 234 that are disposed on an inner facing surface of the receiving member 230 relative to when the receiving member is mounted on the pedestal top 216. The detents 232 and 234 help facilitate the mounting of a lockable access door 236 that forms part of the display case 217 as will be explained hereinafter in greater detail.

Each of the access door receiving members, such as the right hand access door receiving member 230 further includes an elongated quick release pin, such as a quick release pin 238, that is disposed on the bottom of the access door receiving member. Each quick release pin 238 is of sufficient length and diameter to be received and held in an a upright position in ones of the dowel holes, such as the dowel hole 225, until released under a sufficient pulling force on the access door-receiving member 230 to release the quick release pin from the dowel hole 225.

Each of the access door receiving members 228 and 230 further include a frame receiving mounting pin, such as a frame receiving mounting pin 240 that help facilitate the mounting of a framed observation window 242 that also forms part of the merchandise display case 217.

The display case 217 also includes a left side glass-receiving member 244 and a right side glass-receiving member 246 that are adapted to be removably mounted in the dowel holes 222 and 223 respectively.

Each glass receiving member, such as the right side receiving member 246, is milled with a back side glass receiving slot, such as a back side glass receiving slot 247, that extends along the entire longitudinal length of the rear surface of the glass receiving member relative to when the receiving member is mounted on the pedestal top 216.

In addition, each glass receiving member, such as the right side receiving member 246, is milled with a glass-receiving slot, such as a glass-receiving slot 248, that extends along the entire longitudinal length of an inner facing surface of the glass-receiving member relative to when the receiving member is mounted to the pedestal top 216.

Each of the glass-receiving members, such as the right side receiving member 246 further includes an elongated quick release pin, such as a quick release pin 249, that is disposed on the bottom of the glass-receiving member. Each quick release pin 249 is of sufficient length and diameter to be received and held in an upright position in ones of the dowel holes, such as the dowel hole 222, until released under a sufficient pulling force on the glass-receiving member to release the quick release pin from the dowel hole.

Each of the glass receiving 244 and 246 further include a frame receiving mounting 44 pin, such as a frame receiving mounting pin 251 that further help facilitate the mounting of a framed observation window 242 that forms part of the merchandise display case 217.

As best seen in FIG. 2, the glass receiving members 244 and 246 cooperate with the access door receiving members 228 and 230 respectively to help facilitate the mounting of a left side transparent wall 253 and a right side transparent wall 255 that form part of the display case 217. The transparent walls 253 and 255 are composed of any transparent material selected from the group of scratch resistant acrylic, tempered glass, plastic and glass. The glass-receiving members 244 and 246 also cooperate with one another to facilitate the mounting of a front transparent wall 257 that also forms part of the display case 217. The front transparent wall 257 like the walls 253 and 255 is also composed of any transparent material selected from the group of scratch resistant acrylic, tempered glass, plastic and glass. The front transparent wall 257, the left side transparent wall 253, and the right side transparent wall 255 are mounted removably by insert them in the glass receiving slots of the respective ones of the receiving members.

Figure 30:
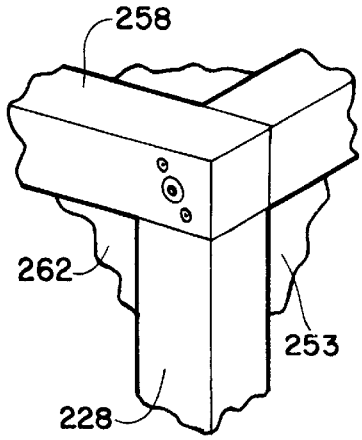
FIG. 30 is an enlarged fragmentary view of the interconnection between frame members of FIG. 2, illustrating a setscrew that helps secure the frame members together.

Considering now the access door 236 in greater detail with reference to FIG. 2, the access door 236 generally includes an upper frame member 258 having an elongated slot 259, and a lower frame member 260 having an elongated slot 261. The upper frame member 258 and the lower frame member 260 cooperate together to secure therebetween a sheet of transparent material 262. In this regard, a set of spaced apart set screws, such as a set screw 277 as best seen in FIG. 30, are disposed in each frame member to respectively, permit the square sheet of transparent material 262 to be received and held in a friction tight fit within the slots of the frame members. The transparent material 262 is selected from the group of scratch resistant acrylic, tempered glass, plastic and glass.

The distal ends of the upper and lower frame members 258 and 260 terminate in detent receiving balls, such as a detent receiving ball 264, that cooperate with the upper and lower detents in the access door receiving members 228 and 230 to enable the access door 236 to be removably mounted between the access door receiving members 228 and 230.

As best seen in FIG. 2, the upper frame member 258 has mounted thereto a key lock mechanism 266 that engages when disposed in a locked position, the framed observation window 242 when the window 242 is installed on the frame receiving pins 240 and 251 disposed on the respective access door receiving members 228 and 230 and glass receiving members 244 and 246.

As best seen in FIG. 2, the display case 217 has a box-like configuration. However, it should be understood by those skilled in the art that the collapsible display case could be configured in a trapezoidal shape simply by modifying the shape and size of the frame members and glass sheets. Therefore there is no intention of limiting the present invention to a box-like display case as other geometric shapes are contemplated.

Considering now the framed observation window 242 in greater detail with reference to FIG. 2, the framed observation window 242 generally includes a frame 268 that surrounds a sheet of tempered glass 270. The sheet of tempered glass 270 is mounted within the frame in a conventional manner. A set of pin receiving holes, such as pin receiving holes 272–275 are disposed on the underside of the frame 268 and spaced at corresponding ones of the frame corners to facilitate the mounting of the framed window 242 to the frame receiving pins, such as the frame receiving mounting pin 251. In short then, the pin receiving holes disposed on the underside of the frame 268 are aligned with the respective ones of the frame receiving mounting pins, such as the pin 251, by the user, who then presses the framed observation window 242 onto the pins 251 so the window 242 is secured in a stable and sturdy manner.

Considering now the method of mounting the display case 17 to the pedestal top 216, after the pedestal top 216 has been secured to the pedestal base 214 as previously described, the user insert the right side glass receiving member 246 into the right front dowel hole 222 until the bottom of the glass receiving member 246 abuts the top surface of the pedestal top 216 providing an indication to the user that the quick release pin 249 has cleared the bottom of the dowel hole 222.

The user then inserts the left side glass receiving member 244 into the left front dowel hole 223 until the bottom of the glass receiving member 244 abuts the top surface of the pedestal top 216 providing an indication to the user that the quick release pin 249 has cleared the bottom of the dowel hole 223.

The user then inserts the left side access door receiving member 228 into the left rear dowel hole 224 until the bottom of the access door receiving member 228 abuts the top surface of the pedestal top 216 providing an indication to the user that the quick release pin 238 has cleared the bottom of the dowel hole 224.

Next, the user inserts the right side access door receiving member 230 into the right rear dowel hole 225 until the bottom of the access door receiving member 230 abuts the top surface of the pedestal top 216 providing an indication to the user that the quick release pin 238 has cleared the bottom of the dowel hole 225.

It should be understood by those skilled in the art, that the access door receiving members 228 and 230 as well as the glass receiving members 244 and 246 are removably secured within their respective dowel holes and cannot be removed unless the user pulls them upwardly with a sufficient force to allow the quick pin release to be activated. This is an important feature since it allows the individual sheets of glass forming the side and front walls 253, 255, and 257 respectively to be individually removed without the danger of one of the receiving members being dislodged from its dowel hole.

Next the user inserts the left side transparent wall 253 into the facing glass receiving slots on glass receiving member 244 and access door receiving member 228 until the bottom of the wall 253 abuts the top surface of the pedestal top 216.

The user then inserts the right side transparent wall 255 into the facing glass receiving slots on glass receiving member 246 and access door receiving member 230 until the bottom of the wall 255 abuts the top surface of the pedestal top 216.

The user next inserts the front transparent wall 257 into the facing glass receiving slots on the glass-receiving members 244 and 246 until the bottom of the wall 257 abuts the top surface of the pedestal top 216.

The access door 236 detent receiving balls 264 are then engaged with the top and bottom detents in respective ones of the left side access door receiving member 228 and the right side access door receiving member 230 so the access door 236 can be pivotally moved from an open position to a closed position.

Next, the user mounts the framed observation window 242 on the mounting pins 240 and 251. The lock mechanism 266 is then engaged with the frame 268 of the framed observation window 242 locking the access door 236.

From the foregoing, those skilled in the art will understand that the display arrangement 210 functions as an attractive collapsible display stand with a collapsible merchandise display case that is constructed for displaying valuable objects in a safe and secure manner.

C. A Display Kit and Display Arrangement Having Bridged Pedestal Base Units and Pedestal Display Top with a Centered Square Display Case.

Figure 3:
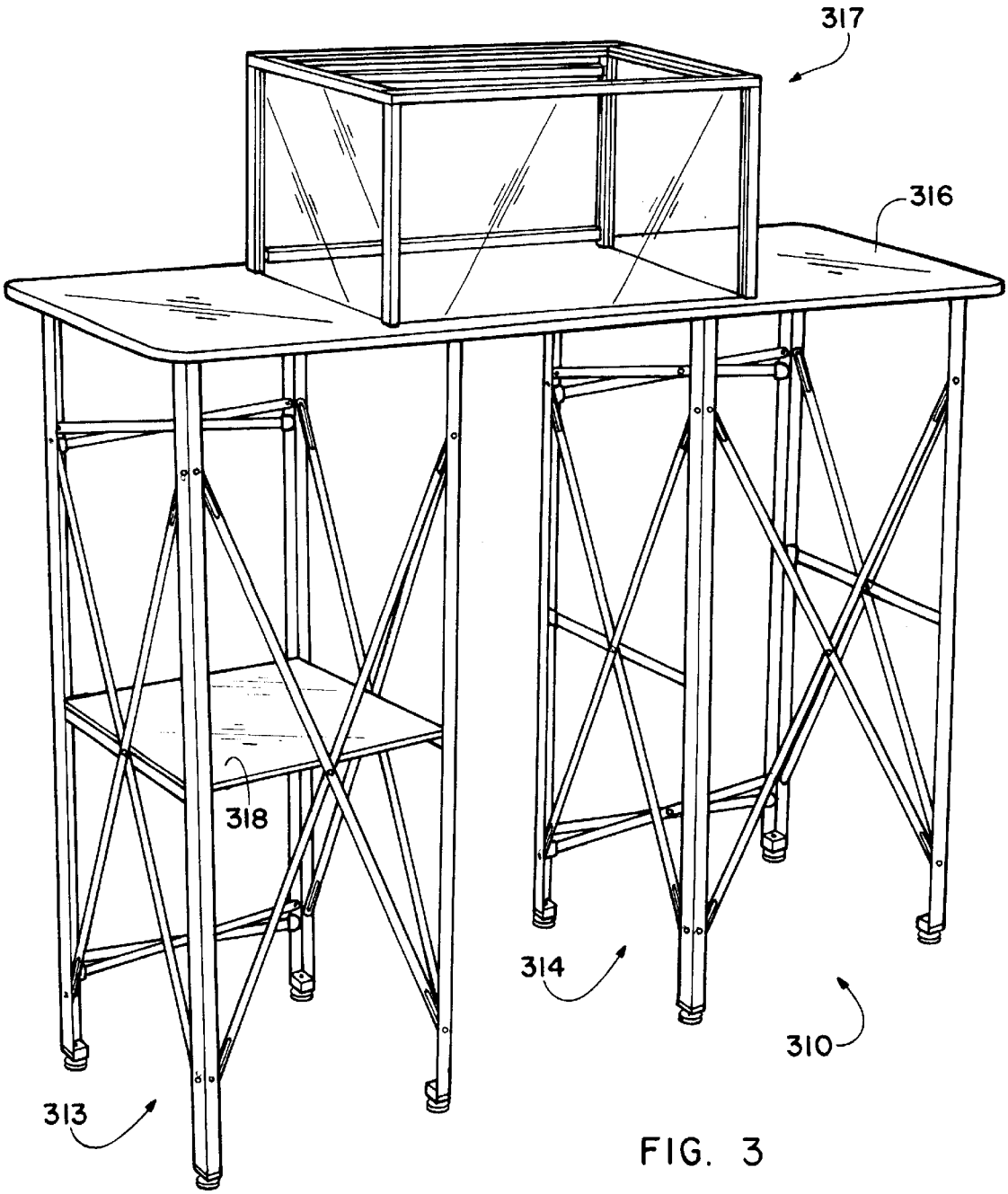
FIG. 3 is a pictorial view illustrating the elements of still yet another display arrangement kit, which is constructed in accordance with the present invention.
Figure 21:
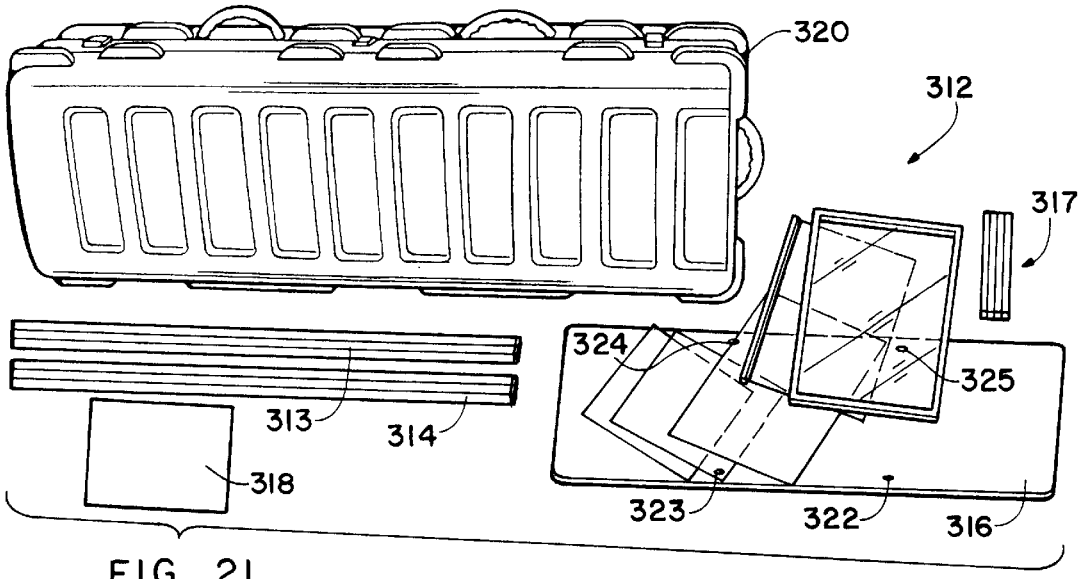
FIG. 21 is a greatly reduced pictorial view of the display kit of FIG. 3, illustrating the operative elements and a double wide carrying case.

Referring now to the drawings and more particularly to FIGS. 3 and 21 thereof there is illustrated another display arrangement 310 and display kit 312 that is constructed in accordance with the present invention. The display arrangement 310 is lightweight, collapsible and in accordance with a novel method of assembly, the display arrangement 310 is easily set-up or assembled without the use of mounting hardware or mounting hardware tools as will be explained hereinafter in greater detail.

Considering now the display arrangement 310 and display kit 312 in greater detail with reference to FIGS. 3 and 20, the display kit 312 includes a pair of substantially similar collapsible pedestal base units 313–314, an elongated pedestal top 316, a collapsible merchandise or object display case 317, an intermediate shelf unit 318 and a double wide transportation case 320 as best seen in FIG. 3. The collapsible pedestal base units 313–314, pedestal top 316, and collapsible display case 317 are stored in the storage case 320 when not in use. When the pedestal base units 313–314, pedestal top 316, and collapsible display case are removed from the storage case 320, they are easily assembled together without the use of hardware or hardware mounting tools in accordance with the novel method of assembly of the present invention. When assembled, the resulting display arrangement 312 provides a stylish, attractive merchandise display stand design that can be easily assembled and disassembled to facilitate transporting the display arrangement 312 from trade show to trade in a convenient manner.

As the pedestal base units 313–314, collapsible display case 317, and intermediate shelf 318, are substantially similar to pedestal base unit 14, and collapsible display case 217, and intermediate shelf 18, they will not be described hereinafter in greater detail.

Considering now the display kit 312 in greater detail, the display kit 312 includes a pedestal top 316 that is substantially similar to pedestal top 216 except that the pedestal top 316 is longer in length and includes a front set of dowel holes 322–323 and a rear set of dowel holes 324–325 that are centrally disposed in a square configuration at about the center of said pedestal top 316. The dowel holes 322–325 extend completely through the pedestal top 316 and are space apart from one another to enable the collapsible display case 317 to be removably mounted to the topside of the pedestal top 316 in a fast and convenient manner.

It should be understood by those skilled in the art, that the dowel holes 322–325 may also be offset either to the right side of the pedestal top 216 or to the left side of the pedestal top. Moreover, a second set of dowel holes or even a third set of dowel holes may be provided in the pedestal top to accommodate different collapsible display case arrangements. Accordingly, there is no intention of limiting the present invention to a single centrally disposed display case as other display case arrangements are contemplate within the scope of the present invention.

As the method of assembling and disassembling the individual ones of the pedestal base units 314–315 is substantially similar to the assembly and disassembly of the pedestal base unit 14, such methods will not be described hereinafter in greater detail.

In a similar manner, since the assembling and disassembling of the display case 317 is similar to the assembly and disassembly of display case 217, such methods also will not be described hereinafter in greater detail.

Considering now the method of assembling the display arrangement 310, after assembling the individual ones of the pedestal base units 313–314, the pedestal base units 313–314 are spaced apart from one another to allow the pedestal top 316 to be mounted between the pedestal base units 313–314 on the tops of their individual supports legs much in the same manner as described earlier relative to the pedestal top 16. After the pedestal top 316 is mounted to the pedestal base units 313–314, the individual pedestal base units 313–314 are then secured in place locking them to the pedestal top 316 in the same manner as described earlier relative to the pedestal base unit 14 and the pedestal top 16. The collapsible display case 317 is then mounted to the top of the pedestal top 316.

D. A Display Kit and Double Wide Display Arrangement Having an Angled Display Case Including a Low Voltage Lighting Strip.

Figure 4:
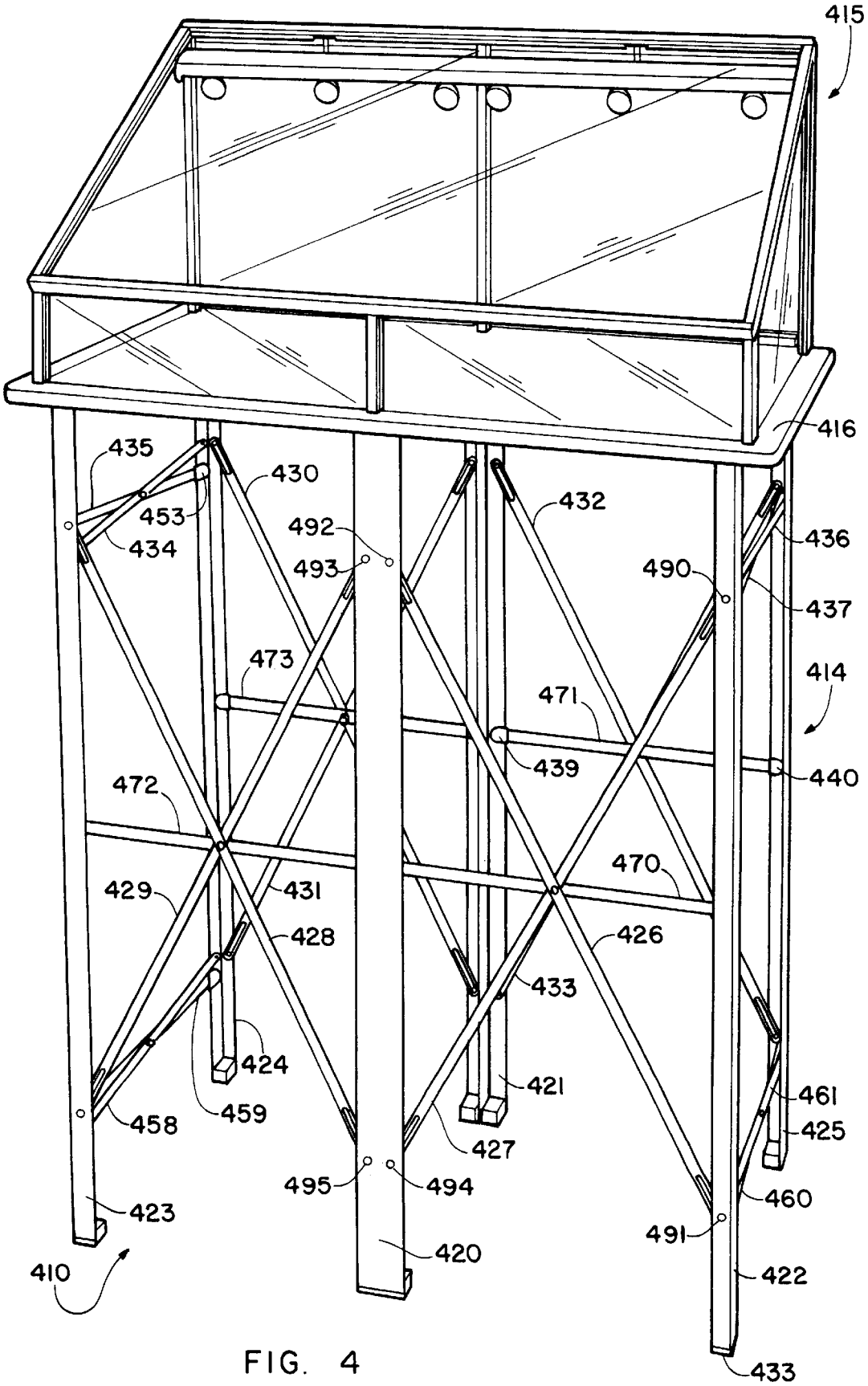
FIG. 4 is a pictorial view illustrating operative element of still yet another display arrangement kit, which is constructed in accordance with the present invention.
Figure 22:
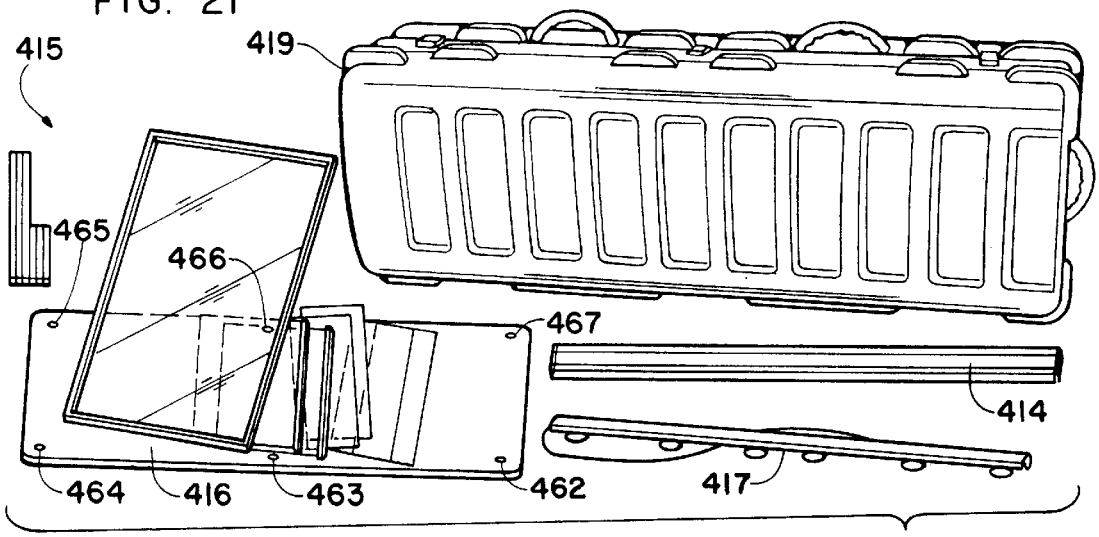
FIG. 22 is a greatly reduced pictorial view of the display kit of FIG. 4, illustrating the operative elements and a double wide carrying case.

Referring now to the drawings and more particularly to FIGS. 4 and 22 thereof there is illustrated a display arrangement 410 and display kit 412 that is constructed in accordance with the present invention. The display arrangement 410 is lightweight, collapsible and in accordance with a novel method of assembly, the display arrangement 410 is easily set-up or assembled without the use of mounting hardware or mounting hardware tools as will be explained hereinafter in greater detail.

Considering now the display arrangement 410 and display table kit 412 in greater detail with reference to FIGS. 4 and 22, the display kit 412 includes a collapsible support entity or pedestal base unit 414, a ridged planar primary supporting surface or pedestal top 416, a collapsible merchandise display case 415, a light strip 417, and a double wide transportation unit or storage case 419 as best seen in FIG. 22. The collapsible pedestal base unit 414, pedestal top 416, collapsible display case 415 and light strip 417 are stored in the storage case 419 when not in use or when being transported between different destinations, such as between different trade shows. When the pedestal base unit 414 and pedestal top 416, collapsible merchandise display case 415 and light strip 417 are removed from the storage case 419, they are easily assembled together without the use of hardware or hardware mounting tools in accordance with the novel method of assembly of the present invention. When assembled, the combined pedestal base unit 414, pedestal top 416, merchandise display case 415 and light strip 417 provide a stylish, attractive display arrangement 410 that can be utilized in a tradeshow for displaying valuable merchandise in a safe and secure manner.

Considering now the pedestal base unit 414 in greater detail with reference to FIG. 4, the pedestal base unit 414 generally includes a set of elongated L-shaped outer support legs, such as outer support legs 422–425 and a set of elongated T-shaped inner support legs 420–421. The bottoms of each of the support legs 420–425 are capped and include height adjusters, such as a height adjuster 433, that enable the pedestal base unit 414 to be leveled when placed on an uneven ground surface.

Figure 5:
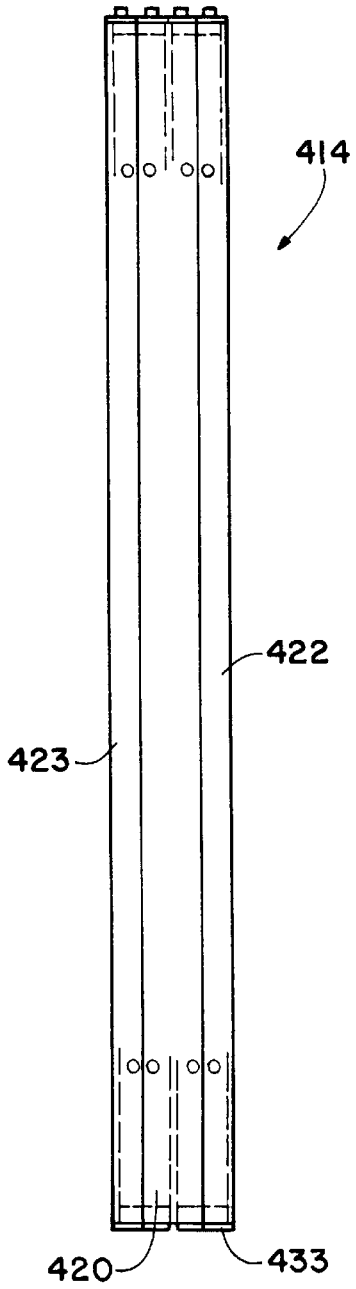
FIG. 5 is front plan view of a collapsible pedestal base unit of FIG. 4, illustrating the pedestal base unit in its fully collapsed configuration.

As best seen in FIG. 5, the inner support legs 420–21 are sandwiched between the outer support legs 422–425 when the pedestal base unit 414 is in a collapsed state. The inner support legs 420–421 and outer support legs 422–425 are interconnected by a set of elongated slotted cross-legged brace members, such as slotted cross-legged brace members 426–433 respectively. In this regard, the cross-legged brace members are arranged in brace member pairs, such as brace member pairs 426–427, 428–429, 430–431, and 432–433. Brace member pairs 426–427 and 432–433 are respectively connected at one of their ends to the inner support legs 420 and 421 and at the other respective one of their ends to the outer support legs 422 and 425. In a similar manner, the cross-legged brace member pairs 428–429 and 430–431 are respectively connected at one of their ends to the inner support legs 420 and 421 and at the other respective one of their ends to the outer support legs 423 and 424.

As will be explained hereinafter in greater detail, the pedestal base unit 414 is collapsible first along its longitudinal axis and then along its lateral axis or alternatively first along its lateral axis and then along its longitudinal axis into an elongated bar like configuration for easy storage and transportation as best seen in FIG. 5. For example, when a fully expanded pedestal base unit with dimensions of about 18-inches by 33.5-inches by 36-inches, is collapsible into a 4-inch by 4-inch bar 36-inches in length.

Pairs of the cross-legged brace members, such as the cross-legged member pairs 426–427, 428–429, 430–431 and 432–433 are pivotally secured at about their center longitudinal axes and are slidably mounted between pairs of the support legs, such as the pairs 420–422, 420–423, 421–424, and 421–425 respectively. For example, cross-legged member pair 426–427 is secured pivotally together at their respective longitudinal centers in a manner similar to cross-legged member pairs 26–27 as described previously.

As the other cross-legged member pairs 428–429, 430–431, and 432–433 are pivotally mounted together in a similar manner the mounting arrangement will not be described hereinafter in greater detail. It should be noted however, that the mounting of the cross-legged member pairs pivotally together with their respective support bracing bars 470–473 that will be described hereinafter in greater detail is only done once at the manufacturing stage.

As the structure of each pair of the cross-legged members, such as cross-legged members 426–427, is similar to cross-legged pair members 26–27, the cross-legged members 426–433 will not be described in further detail. It should be noted however, that the elongated slots in the cross-legged members, such as the cross-legged members 426–427, help facilitate the mounting of the cross-legged members between opposing support legs, such as supporting legs 420–422. As the manner in which any pair of the cross-legged members are slidably mounted to a pair of the inner and outer support legs is the same, only the mounting arrangement for the pair of cross legged members 426–427 will be described in greater detail with reference to the pair of support legs 420–422.

Considering now the inner and outer support legs 420 and 422 respectively, each inner support leg 420 is generally T-shaped and each outer support leg is generally L-shaped. Each outer support leg, such as outer support leg 422, includes a pair of spaced apart counter bore drill holes, such as the holes 490 and 491 respectively. Each inner support leg, such as inner support leg 420, includes two pair of spaced apart counter bore drill holes, such as the hole pair 492–493, and the hole pair 494–495. The individual holes 490–495 are disposed spaced from the distal ends of their respective supporting leg a sufficient distance in order to permit the cross legged members to slide either upwardly or downwardly along or adjacent an inside wall of their corresponding support legs without extending beyond the distal end of the corresponding supporting legs.

Also during a manufacturing phase only, the cross-legged member 426 is slidably mounted to a top portion of inner support leg 420 in a manner similarly described relative to cross legged member 26 an support leg 22. This mounting process is done at the manufacturing stage of construction only as the cross-legged members thereafter are permanently mounted to their respective support legs as described herein.

The other cross-legged brace member 427 is mounted to a bottom portion of inner support leg 420 and an upper portion of outer support leg 422 in a similar manner with similar hardware during the manufacturing phase of construction. With this manner of mounting the cross legged pair 426–427, it should be understood by those skilled in the art, that when the inner support leg 420 and the outer support leg 422 are pushed toward one another from their fully expanded positions, the cross-legged brace members 426–427 respond by the cross legged member 426 riding upwardly on or adjacent to the inside wall of inner support leg 420 and downwardly on or adjacent to the inside wall of leg 422 a sufficient distance to permit the pair of cross-legged brace members 426–427 to come into contact with one another in an upright parallel configuration to help form a tight bar-like configuration as best seen in FIG. 5.

In a similar manner while support legs 421 and 425 are being pushed toward one another, cross-legged brace members 432–433 are also being pushed together in a similar upright parallel configuration. This same accordion type of closing is also experienced by cross legged brace members 428–429 and 430–431 as the outer leg members 423 and 424 are pushed towards inner support leg members 420 and 421 respectively. In this manner, a lateral closing of the pedestal base unit 414 is affected.

Conversely, when the outer support leg 422 is pulled away from the inner support legs 420, the cross legged member 426 rides downwardly on or adjacent the inside wall of inner support leg 420 and upwardly on or adjacent to the inside wall of leg 422 to permit a right side expansion of the pedestal support base 214 along its lateral axis. A similar expansion occurs as the outer support leg 425 is pulled away from inner support leg 421. In a similar manner when outer support legs 423 and 424 are pulled away from inner support legs 420 and 421 respectively, a left side expansion of the pedestal support base 414 is permitted along its lateral axis.

As best seen in FIG. 4, each of the cross brace member pairs, 426–427, 428–429, 430–431, and 432–433, includes a set of stabilizing braces, such as the stabilizing braces 470–473, that help stabilize the inner and outer support legs as will be explained hereinafter in greater detail.

When the pedestal base unit 414 is in a collapsed state the stabilizing braces 470–473 are disposed in a position parallel to the inner and outer support legs. When the pedestal base unit 414 is expanded, the stabilizing braces are pivotally rotated about their corresponding cross legged brace members to engage and stabilize the respective inner and outer leg pairs: 420–422, 420–423, 421–424, and 421–425 as best seen in FIG. 4.

In order to bring a stabilizing braces, such as the stabilizing braces 471, into a friction tight fit between its associated inner and outer support legs, the distal ends of each stabilizing bar is capped with a rubber cap, such as caps 439 and 440, that have a sufficient length to cause interference between the stabilizing brace and its associated inner and outer support legs.

The upper distal end of each of the support legs 422–425 is capped with a bottom pedestal locator that is substantially similar to pedestal locator 41, which has been previously described. In this regard, the bottom pedestal locator will not be described in greater detail hereinafter.

As best seen in FIGS. 1 and 5, the pedestal base unit 414 also includes a set of upper bow tie brace members 434–435 and 436–437 respectively and a set of lower bow tie brace members 458–459 and 460–461 respectively. Each pair of the bow tie brace members, such the bow tie brace members 434–435 is pivotally connected in a slightly offset manner from their respective centers.

Respective ones of the members 434–435 are also pivotally mounted to opposite ones of the support legs 423 and 424 respectively. More particularly, one end of securing member 434 is pivotally mounted to a top portion of support leg 423 and one end of securing member 435 is pivotally mounted to top portion of support leg 424. The opposite ends of the securing members 434 and 435 respectively are free and thus, are able to be moved toward or away from each other about their offset pivot points about bolt 455. In this arrangement, each one of the free ends of the securing members 434 and 435 respectively may be rotated into engagement with an opposing support leg to provide an outwardly directed cam action that locks or secure the pedestal top 416 to the supporting legs 422–425 respectively as will be explained hereinafter in greater detail.

Rubber stops, such as a rubber stop 453, are disposed on the free ends of the securing members 434 and 435 respectively. The rubber stops permit the cross-legged support brace members 434–435 to be moved into friction tight engagement with the support legs 424 and 423 respectively. As mentioned earlier, it is in this manner that the pedestal top 416 is locked or secured to the pedestal base 414.

As the construction and operation of the other pairs of securing or bow tie brace members 436–437 and 460–461 relative to outer support members 422 and 425 and bow tie brace members 458–459 relative to outer support members 423–424 is similar to the construction and operation of the support brace members 434–435, there will be no further description of their construction or operation.

Once the pedestal base unit 414 and pedestal top 416 have been aligned and mated together, they are locked or secured in place utilizing the support brace member 434–435 and 436–437 respectively, and then the support brace members 458–459 and 460–461 respectively.

Considering now the pedestal top 416 in greater detail with reference to FIG. 22, the pedestal top 416 is a ridged planar supporting surface having an overall square shape with smooth rounded corners and edges. The underside of the pedestal top 416 is milled out to provide a set of four locating notches, such as the locating notch 54 described previously relative to top 16. The locating notches are disposed adjacent to respective one of the corners of the pedestal top 416. Each locating notch is dimensioned to receive in a friction tight removable fit a corresponding one of the bottom pedestal locators, which bottom pedestal locators are each substantially similar to bottom locator 51 previously described and as best seen in FIG. 13. In short then, during use, the pedestal locators and locating notches enable a user quickly align and mount the pedestal top 416 to the pedestal base unit 414 or conversely quickly remove the pedestal top 416 from the pedestal base unit 414, whichever the case may be relative to assembly or disassembly of display arrangement 410.

Figure 16:
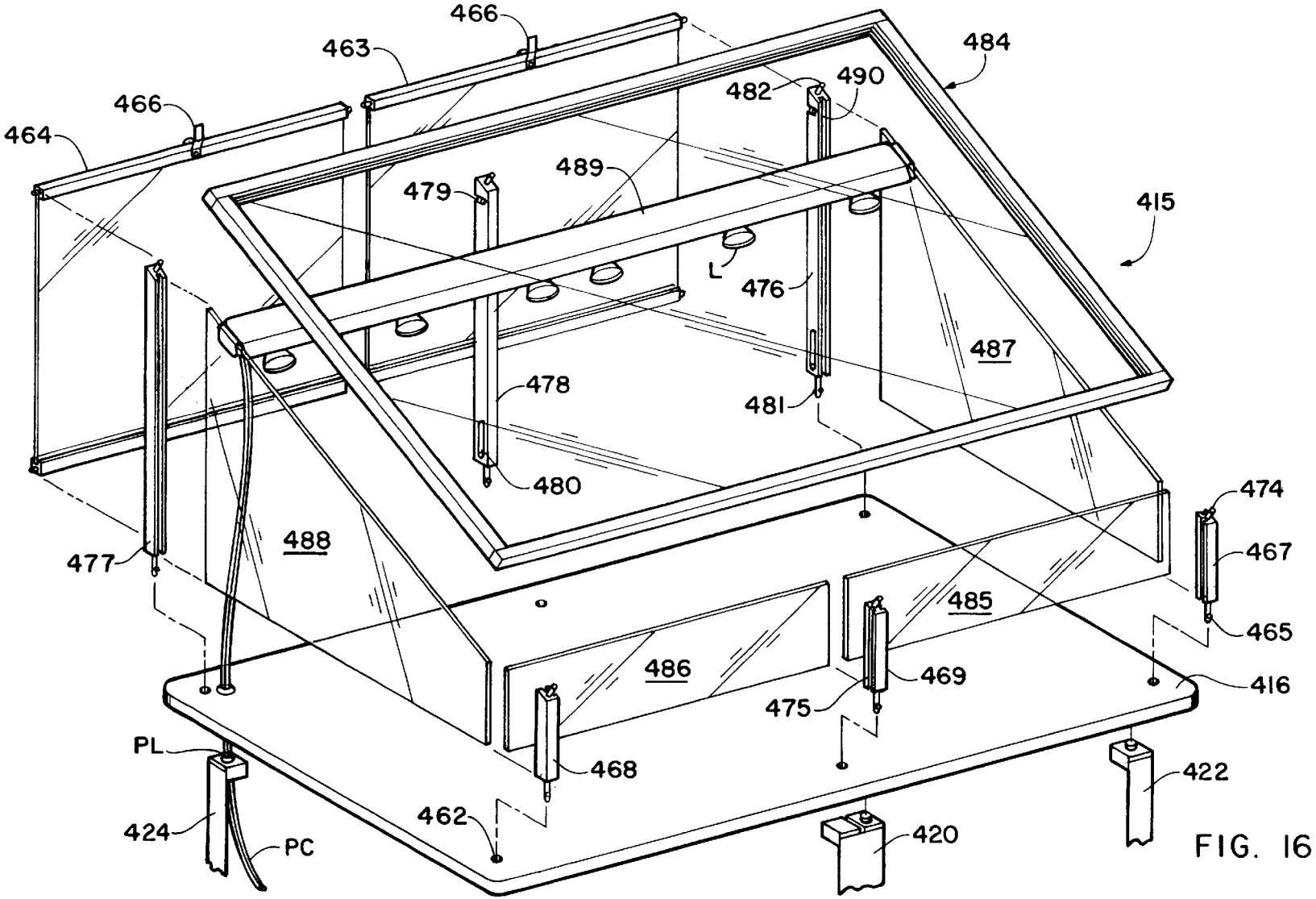
FIG. 16 is an enlarged exploded view of an object display case of FIG. 4.

As best seen in FIG. 16, the pedestal top 416 also includes a set of spaced apart dowel holes, such as dowel holes 462–467. The dowel holes 462–467 are located in close proximity to an edge portion of the pedestal top 16. As will be explained hereinafter in greater detail, the location of the dowel holes is an important feature of the present invention, as their location facilitates the easy installation and removal of the merchandise display case 415.

Considering now the display case 415 in greater detail with reference to FIG. 16, the display case 415 is removably mounted to the upper surface of the pedestal top 416. The merchandise display case 415 is a doublewide display case having a plurality of frame members that are removably mounted to the pedestal top 416. The frame members include a right front frame member 467, a left front frame member 468, and a center front frame member 469 that is disposed equal distance from the right front frame member 467 and the left front frame member 468 at about the front edge of the pedestal top 416. The construction of the front frame member 469 is similar to frame members 467 and 468 except that the frame member 469 includes slots on both its inner side surfaces, such as a slot 475 as best seen in FIG. 16.

The construction of the right front frame member 467 and the left front frame member 468 is similar to the construction of the frame member 246 described previously and therefore they will not be described in greater detail except to note, that each of the frame members 467 and 468 are shorter and each includes a quick release pin, such as a quick release pin 465, and a window mounting pin 474 that is angled forward to facilitate receiving and supporting a top observation window frame 484 forming part of the display case 415.

The frame members also include a right rear frame member 476, a left rear frame member 477, and a center rear frame member 478 that is disposed equal distance from the right rear frame member 476 and the left rear frame member 477 at about the rear edge of the pedestal top 416 when it is secured to the pedestal top 416. The construction of the center rear frame members 478 is similar to frame members 476 and 477 except that the frame member 478 includes upper and lower detents on both its inner side surfaces, such as a detent 479 and 480 respectively as best seen in FIG. 16.

The construction of the right rear frame member 476 and the left rear frame member 477 is similar in that each includes an upper and lower detent, such as the upper detent 479 and the lower detent 480 described relative to frame member 478. Each-frame member 476–477 also includes an elongated glass-receiving slot, which is disposed on its front surface, such as a slot 490. Each frame member 476–477 includes a quick release pin, such as a quick release pin 481, and a window-mounting pin 482.

Considering the display case 415 in still greater detail the display case 415 further includes an observation window 484, a pair of front transparent panel members 485–486 and a pair of side transparent panel members 487–488. The front panel members are similar in construction to front panel member 262 except they are shorter. The window 484 is similar in construction to window 242 and will not be described hereinafter in greater detail.

Figure 12:
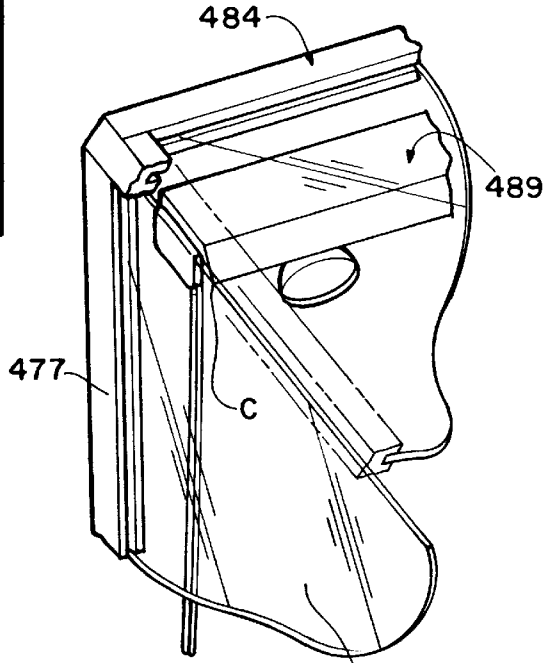
FIG. 12 is an enlarged fragmentary pictorial view of the strip lighting system of FIG. 4, illustrating the mounting arrangement for securing the light strip to the frame of the object display case.

As best seen in FIGS. 4, 12 and 16, the display case 415 also includes a light strip 489 that is mounted between the side panel transparent members 487 and 488. In this regard, the right and left sides of the light strip 489 include a cutout, such as a cutout C that permits the light strip 489 to be mounted below the observation window 484 on the side panel members 487 and 488 respectively. The light strip 489 includes a set of lamps, such as a lamp L that are removably mounted in sockets (not shown), which are secured to the light strip 489. The lamps, such as the lamp L, are powered by a low voltage power source (not shown) that is coupled to the lamps L by an electrical power cord, PC. The power cord PC passes through a position locator PL that has been drilled out to provide an access passage for the power cord PC into the interior of the case 415 when the display case 416 is assembled to the pedestal top 416, as best seen in FIG. 16.

Considering the display case 415 in still greater detail with reference to FIG. 16, the display case 415 further includes, a right side access door 463 and a left side access door 464, each with a key lock mechanism such as a key lock mechanism 466. As the construction of the access doors 463 and 464 is substantially similar to access door 236, so the access doors 463–464 will not be described hereinafter in greater detail.

Figure 6:
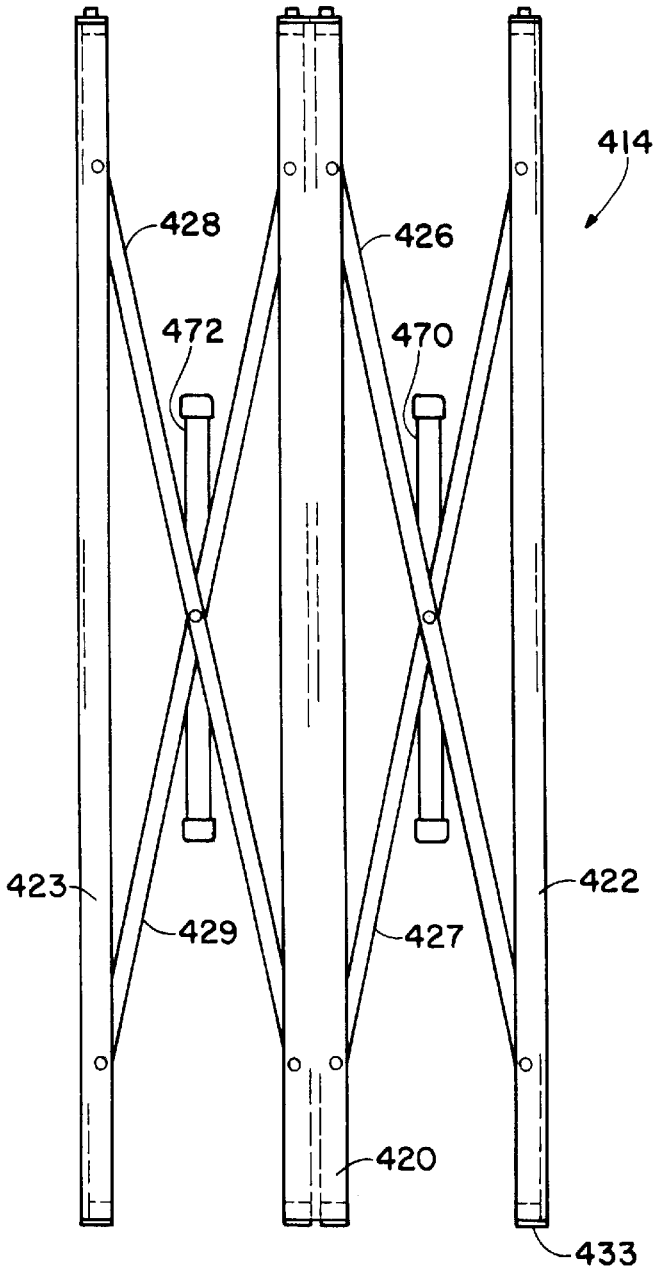
FIG. 6 is a front plan view of the collapsible pedestal base unit of FIG. 4, illustrating the pedestal base unit partially expanded along its longitudinal axis.
Figure 8:
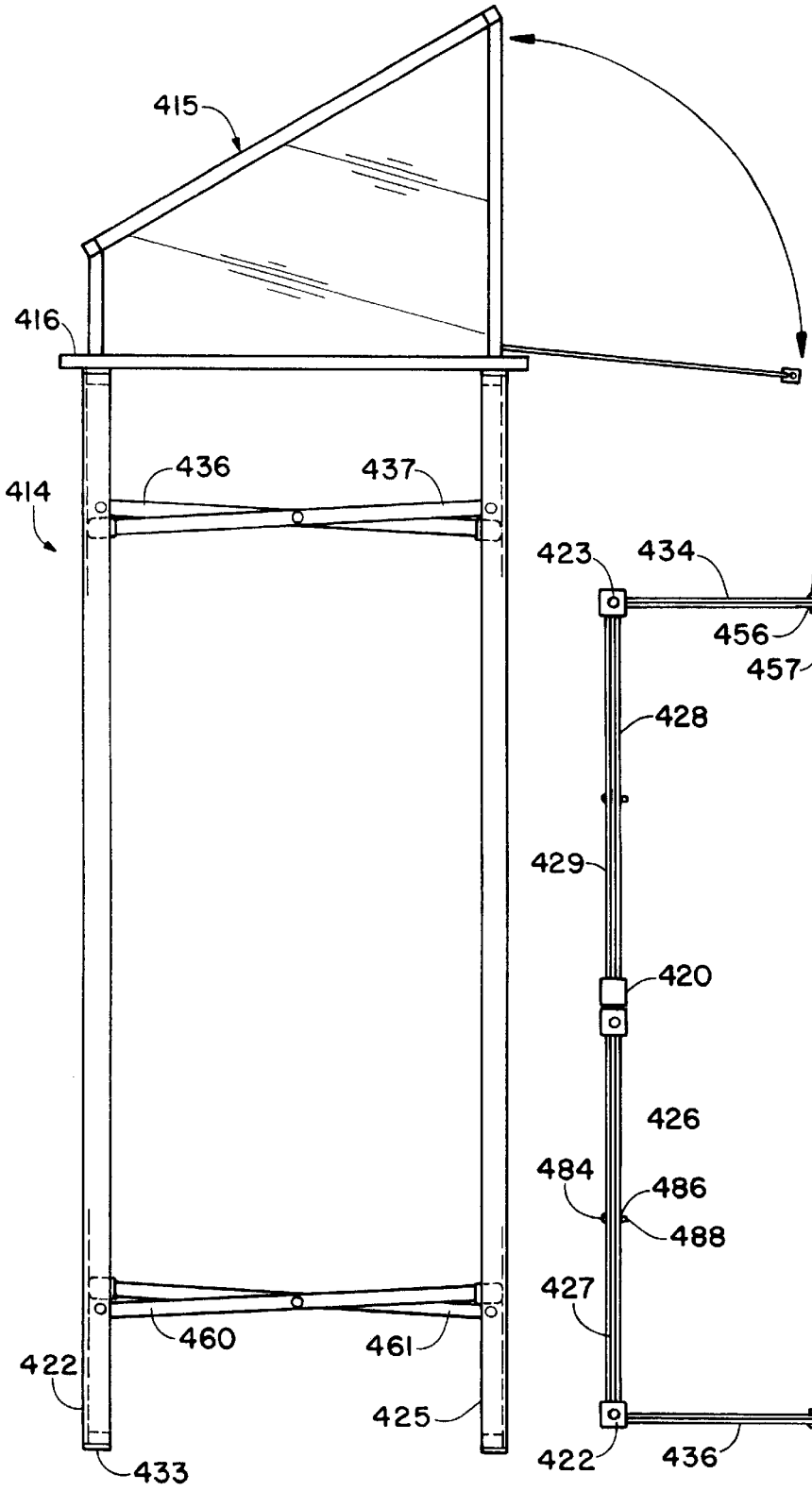
FIG. 8 is a side plan view of the display arrangement of FIG. 4 illustrating a lockable access door in a fully open position.
Figure 7:
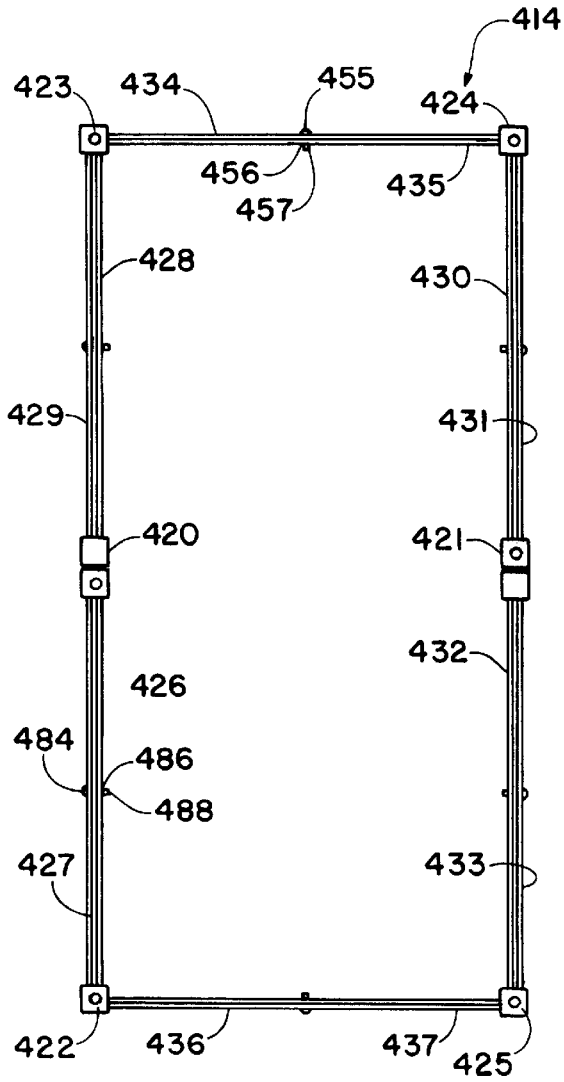
FIG. 7 is a top plan view of the collapsible pedestal base unit of FIG. 4, illustrating the pedestal base unit in its fully expanded configuration.
Figure 9:
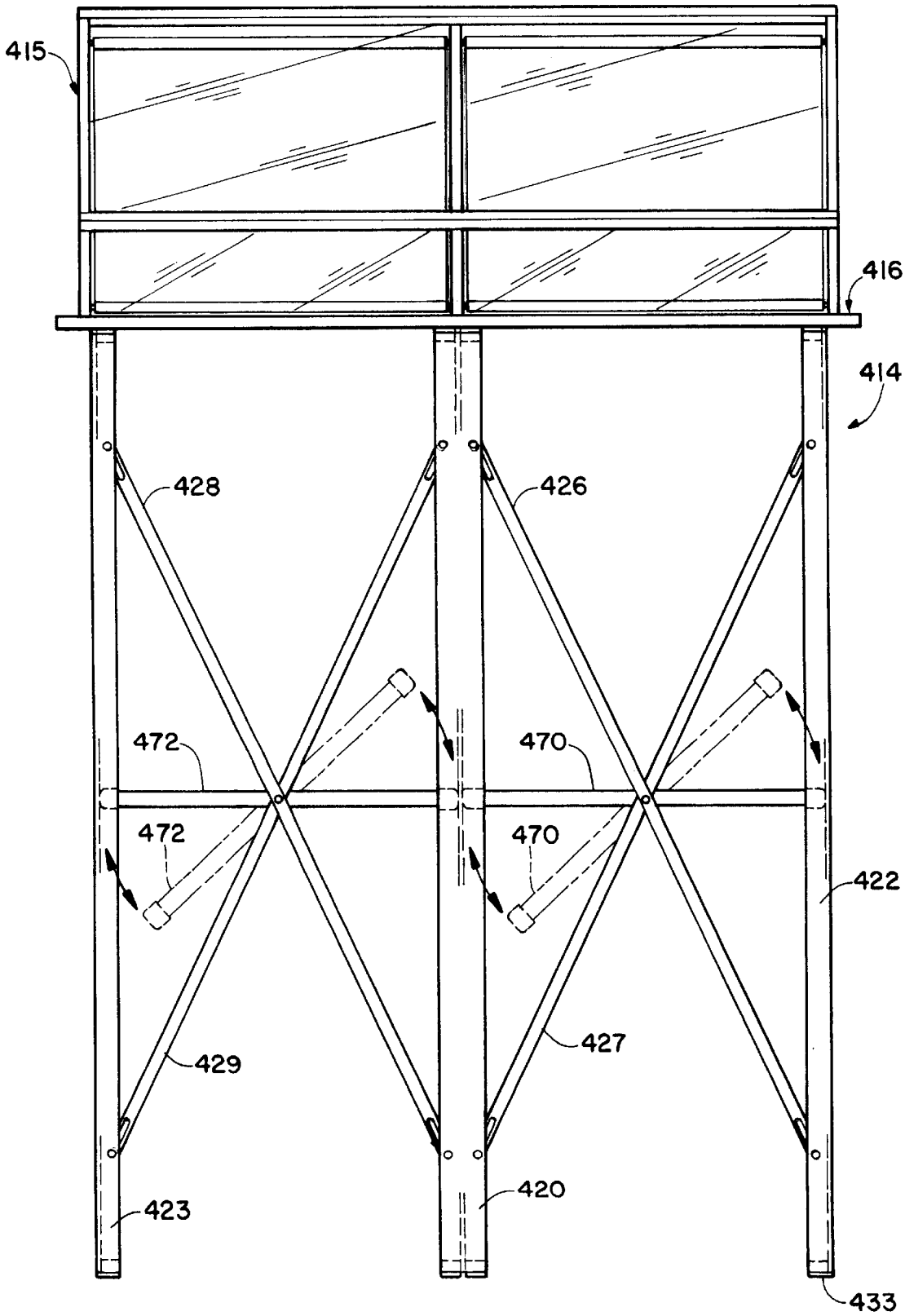
FIG. 9 is a front plan view of the display arrangement of FIG. 4 illustrating in phantom a pair of support members in their unlocked positions.

Considering now the method of assembling the display kit 412 to provide the display arrangement 410 in greater detail the collapsed pedestal base unit 414 is first grasped by all four outer support legs 422–425 as best seen in FIG. 5. The lateral support leg pairs, such as legs 422–425 and 423–424, are then expanded or pulled away from the inner support leg members 420 and 421 respectively in a first or lateral direction until the lateral cross-legged members 426–427, 428–429, 430–431, and 432–433 are fully extended as best seen in FIGS. 6 and 7. The user then releases the support legs 421, 424, and 425 and pushes the longitudinal support legs pairs, such as legs 420–421, 423–424 and 22–425, away from the support legs 421, 424, and 425 until the longitudinal cross-legged members 434–435 and 436–437 are fully extended. This last mentioned expansion action brings the pedestal base unit 412 into a substantially fully expanded configuration allowing the user to place the unit 412 on the ground or floor in a substantially secure upright position as seen in FIG. 7–9.

Once the pedestal base unit 414 is positioned in an upstanding configuration, the support braces 470–471 and 472–473 are rotated from their upright positions into engagement with the inner and outer support members 420–425 as previously described. This braces, supports and stabilizes the pedestal base unit 414.

The user then aligns the locating notches disposed on the underside of the pedestal top 416, with the pedestal locators, disposed on the upper distal ends of respective ones of the support legs 422–425, and presses the locators into their corresponding locator notches securing the pedestal top 416 to the pedestal base 414 in a friction tight removable fit.

To secure or lock the pedestal top 416 to the pedestal base 414, the user presses the free end of cross legged securing member 434 and 435 into friction tight engagement with the interior wall of support leg 423 and 424 and the free end of cross legged securing member 436–437 into friction tight engagement with the interior wall of support legs 422 and 425 to cam the pedestal base unit 414 and the pedestal top 416 into a ridged secure upright stable configuration that is suitable for supporting from below merchandise items as best seen in FIG. 4.

As a final step of assembly, the user places the intermediate shelf units 417–418 into the interior of the pedestal base unit 414 and aligns the shelf units 417–418 in a horizontal plane substantially parallel to the pedestal top 416 and allows the shelf units to rest on the pedestal brace members 470–471 and 472–473 respectively.

In order to disassembly the display arrangement 410, a user follows a reverse process. That is, the user first removes the intermediate shelf units 417–418 from the interior of the pedestal base unit 414. The user then disengages the securing members 434–435 from the support legs 423–424 and the securing members 436–437 from support legs 422–425.

Next, the user removes the pedestal top 416 from the pedestal base unit 414, placing the pedestal top 416 in the storage unit 419.

The user then, collapses the pedestal base unit 412 by pulling the lateral support leg pairs 420–422 and 421–425 towards one another to collapse the right side of the pedestal base unit 414. Next, the user collapses the left side of the pedestal base unit 414 by pulling the support leg pairs 420–423 and 421–424 together.

The user than pulling the longitudinal support legs 420–421, 422–425 and 423–424 towards one another permitting the pedestal base unit 14 to be collapsed into a hollow elongated bar like configuration, where all of the slotted cross-legged brace members 426–433 and the cross-legged securing members 434–437 are disposed within the interior of the collapsed base unit 414. In this manner, there is little dead space within the interior of the collapse pedestal base unit 414.

As best seen in FIG. 5, the outside surface of the collapsed pedestal base unit 414 is a series of smooth planar surfaces that can be stored in a carrying bag (not shown) and then placed in the storage unit 419 with the pedestal top 416 and the intermediate shelf units 417–418 for convenient storage or transportation whichever the case may be.

E. A Display Kit and Double Wide Display Arrangement Having Stacked Display Cases, Squared and Angled, with the Top Angled Display Case Having a Battery Powered Lighting Strip.

Figure 10:
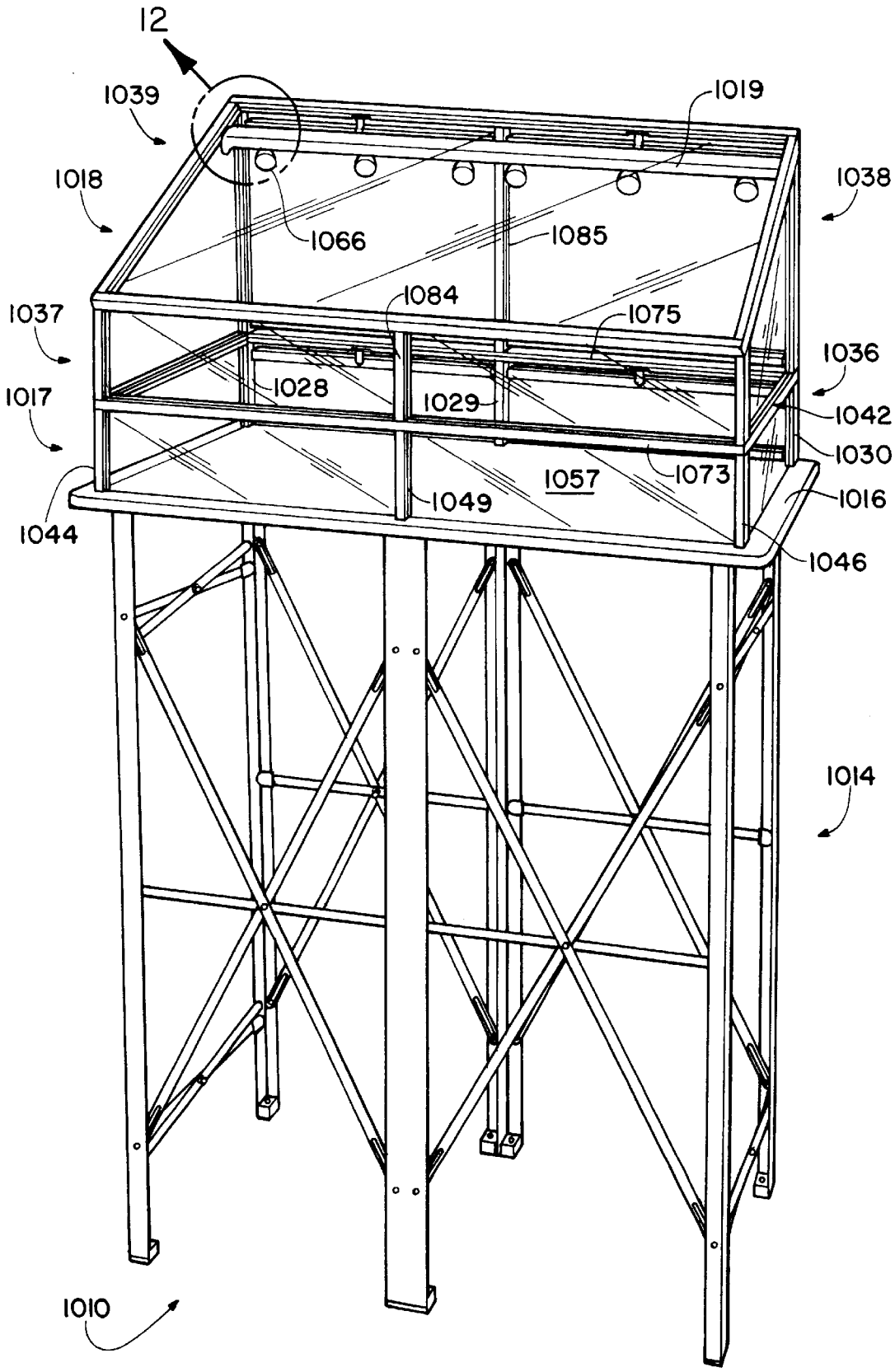
FIG. 10 is a pictorial view of the operative elements of still yet another display arrangement kit, which is constructed in accordance with the present invention.
Figure 23:
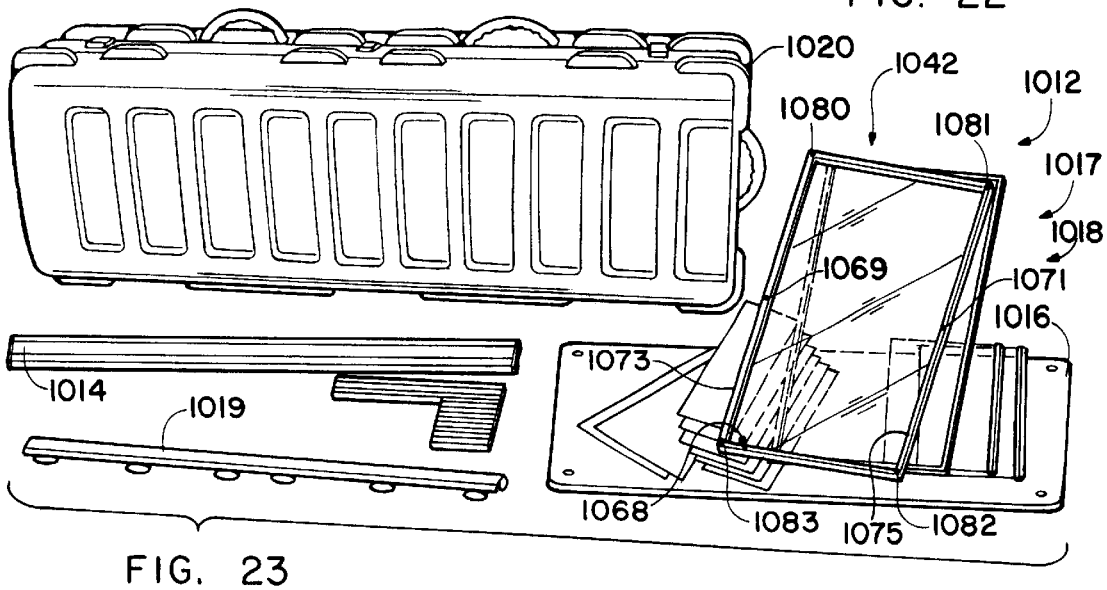
FIG. 23 is a greatly reduced pictorial view of the display kit of FIG. 10, illustrating the operative elements and a double wide carrying case.
Figure 24:
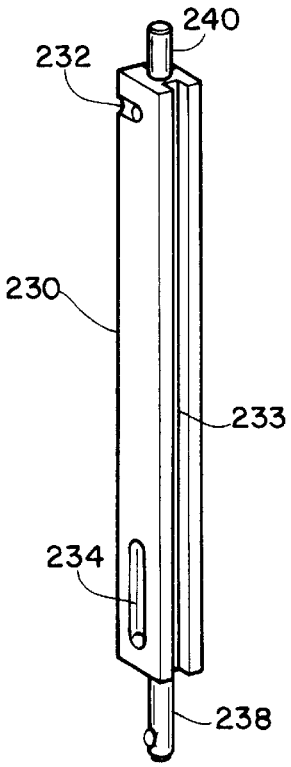
FIG. 24 is a greatly enlarged pictorial view of a frame member of FIG. 2 illustrating its detents.
Figure 25:
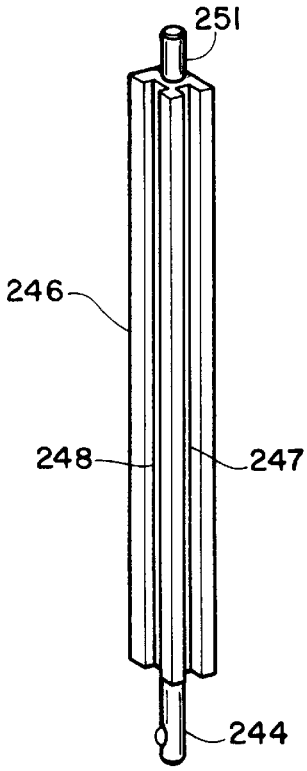
FIG. 25 is a greatly enlarged pictorial view of a frame member of FIG. 2 illustrating its glass receiving slots.

Referring now to the drawings and more particularly to FIGS. 10 and 23 thereof there is illustrated a trade show display arrangement or system 1010 and display kit 1012 that is constructed in accordance with the present invention. The display arrangement 1010 is lightweight, collapsible and in accordance with a novel method of assembly, the display arrangement 1010 is easily set-up or assembled at a trade show booth or trade show floor without the use of mounting hardware or mounting hardware tools as will be explained hereinafter in greater detail.

Considering now the display arrangement 1010 and display kit 1012 in greater detail with reference to FIG. 10, the display kit 1012 includes a collapsible support entity or pedestal base unit 1014, a ridged planar primary supporting surface or pedestal top 1016, a pair of stacked collapsible merchandise display cases, that include a lower rectangular display case 1017 and an upper angled display case 1018, where at least one of the display cases, such as the upper display case 1018 is illuminated with a low voltage light strip 1019. A doublewide transportation unit or storage case 1020 is also part of the kit 1012 to facilitate storage and transportation of the display arrangement 1010.

The collapsible pedestal base unit 1014, pedestal top 1016, and collapsible display cases 1017–1018 are stored in the storage case 1020 when not in use or when being transported between different destinations, such as between different trade shows.

When the collapsible pedestal base unit 1014 and pedestal top 1016, and collapsible merchandise display cases 1017–1018 with the low voltage light strip 1019 are removed from the storage case 1020, they are easily assembled together without the use of hardware or hardware mounting tools in accordance with the novel method of assembly of the present invention. When assembled, the combined pedestal base unit 1014, pedestal top 1016, stacked merchandise display cases 1017–1018 with the low voltage light strip 1019 provide a stylish, attractive trade show display arrangement 1010 that can be utilized in a tradeshow for displaying valuable merchandise in a safe and secure manner. In short, the display system 1010 offers a user with a plurality of convenient features:

1. The system 1010 is collapsible, taking up very little space.
2. The system 1010 is lightweight, easy to handle and relatively inexpensive to ship from trade show to trade show.
3. The system 1010 is shippable and is easily packed into a standard shipping case 1020 that meets airline size and weight regulations.
4. The system 1010 is durable and sturdy, supporting a large number of different types and kinds of objects of art and merchandise in a safe stable manner.
5. The system 1010 is economical and convenient; there are no parts to lose or to wear out.
6. The system 1010 is convenient to utilize in a tradeshow environment, including non-display item storage space within the pedestal base unit 1014 under the pedestal top 1016.
7. The system 1010 is versatile; incorporating both skirts, panels, or drops to give the system a stylish appearance.
8. The system 1010 is attractive and elegant without distracting from displayed objects or works of art or other valuable merchandise items.
9. The system 1010 is easy to utilize, there are no small parts to lose or assemble, and the system 1010 is assembled or disassembled in seconds.

These features result in an easy-to-use display system 1010 with classic lines and modern durability. The display system 1010 can be used not only for temporary displays at trade shows, but because of its stylish appearance it can be utilized in art galleries, public settings as well as in home settings. The attractive stacked and illuminated display cases 1017–1018 include lockable access doors, such as access doors 1036–1037 and 1038–1039 respectively, that permit valuable three-dimensional objects of art and value, such as jewelry, its antique art and collectibles to be displayed in a safe and secure manner. More particularly, the low voltage, high light intensity, light system 1019 mounted within the display cases, transform the system 1010 into the ultimate jewelry case which is perfect for displaying any fine object.

Considering now the display arrangement 1010 and display kit 1012 in greater detail, as the pedestal base unit 1014, pedestal top 1016, and transportation case 1020 are substantially similar to pedestal base unit 414, pedestal top 216, and transportation case 419 that have been previously described; therefore, these previously described elements will not be described hereinafter in greater detail, except for those instances where further discussion will benefit in a better understanding of the present invention.

Figure 26:
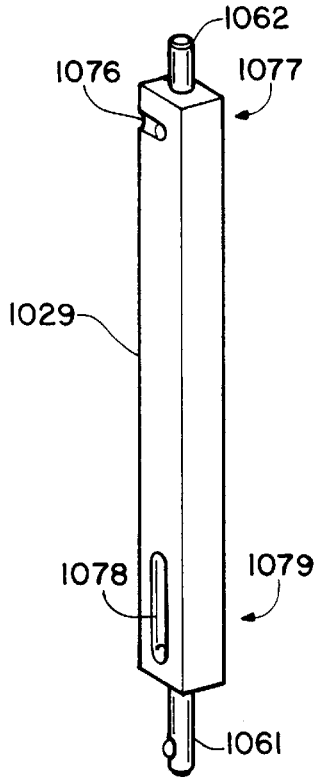
FIG. 26 is a greatly enlarged pictorial view of a frame member of FIG. 10, illustrating its detent slots and mounting pins.

Considering now the stackable collapsible display cases 1017–1018 in greater detail, the collapsible display case 1017 has an over-all box-like configuration, is double wide having a framed observation window 1042 and a plurality of elongated slotted rail or frame members that include a left side access door receiving member 1028, a right side access door receiving member 1030, a left side glass receiving member 1044, a right side glass receiving member 1046 and a pair of intermediate support members 1029 and 1049 respectively as best seen in FIGS. 10 and 26–29. The rail members 1028, 1030, 1044, and 1046 are similar in construction and function relative to members 228, 230, 244, and 246 and will not be described hereinafter in greater detail It should be noted however, that the top end of each rail member 1028, 1030, 1044, and 1046 includes a straight mounting pin, such as a pin 1062 as best seen in FIG. 26. The mounting pins facilitate the mounting of the observation window 1042 and the stacking of the display case 1018 onto the observation window frame members as will be explained hereinafter in greater detail.

Considering now the intermediate support member 1029 in greater detail with reference to FIGS. 10 and 26, the intermediate support member 1029 is an access door supporting or receiving member as well as a framed observation window-supporting member. In this regard, the intermediate access door receiving member 1029 includes on its bottom surface a quick release pin 1061 that is similar in function and structure to pin 238 that has been described previously. In addition, the top end of the intermediate support member 1029 includes a mounting pin that helps facilitate stacking the display case 1018 on the framed observation window 1042 of the display case 1017.

The intermediate support member 1029 also includes on both its right facing surface and its left facing surface upper and lower detent slots, such as an upper detent slots 1076–1077 and lower detent slots 1078–1079 as best seen in FIG. 26. The function or purpose of the upper and lower detent slots are substantially similar to detents 232 and 234, allowing the intermediate support member 1029 to be able to support and receive both a lower right side access door 1036 on its right side and a lower left side access door 1037 on its left side. The access doors 1036 and 1037 are similar in construction to the access door 236 and will not be described hereinafter in greater detail.

Figure 27:
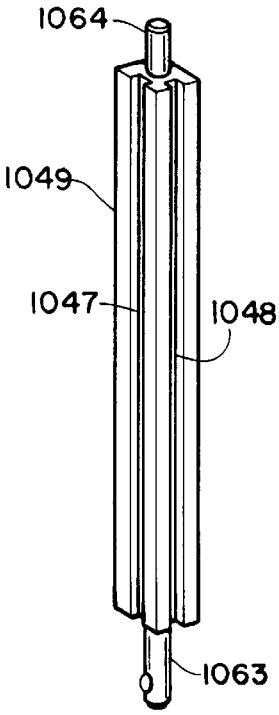
FIG. 27 is a greatly enlarged pictorial view of a frame member of FIG. 10, illustrating its slots and mounting pins.

Considering now the intermediate support member 1049 in greater detail with reference to FIGS. 10 and 27, the intermediate support member 1049 is a glass receiving supporting member as well as a framed observation window-supporting member. In this regard, the intermediate support member 1049 includes on its bottom surface a quick release pin 1063 that is similar in function and structure to pin 238 that has been described previously. In addition, the top end of the intermediate support member 1034 includes a mounting pin 1064 that helps facilitate stacking the display case 1018 on the framed observation window 1042 of the display case 1017 as will be explained hereinafter in greater detail.

The support member 1049 further includes on both its right facing surface and its left facing surface elongated glass receiving slots, such as a glass-receiving slot 1047. The function or purpose of the glass receiving slots, such as the slots 1047–1048 respectively are substantially similar to slot 475, allowing the intermediate support member 1049 to be able to support and receive both a front right side transparent wall 1057 on its right side and a front left side transparent wall 1059 on its left side. The glass walls 1057 and 1059 are similar in construction to transparent walls 485 and 486 except they are somewhat taller and thus, they will not be described hereinafter in greater detail.

Considering now the framed observation window 1042 in greater detail with reference to FIGS. 10 and 23, the framed observation window 1042 is similar in construction to framed observation window 242 except that its includes a window frame 1068 having intermediate pin receiving holes 1069 and 1071 respectively and corner pin receiving holes 1080–1083.

The pin-receiving hole 1069 is centrally located on a front portion 1073 of the window frame 1068. The hole 1069 is dimension to receiving therein the mounting pin 1062 forming a top portion of the intermediate access door support member 1029 without causing interference with the access doors 1036–1037. In a similar manner, a pin-receiving hole 1071 is centrally located on a rear frame portion 1075 of the window frame 1068. The hole 1071 is dimension to receiving therein the mounting pin 1064 forming part of a top portion of the intermediate glass-receiving member 1049 without causing interference with the front glass walls 1057 and 1059 respectively.

The quick release pin receiving holes 1080–1083 are dimensioned to receive the respective mounting pins forming part of the support members 1028, 1030, and 1044 and 1046. In this regard, the holes 1080–1083 enable the window frame 1068 to support the top display case 1018 without interfering with the access doors 1036–1037 or the front glass walls 1057 and 1059 of the lower display case 1017.

Figure 28:
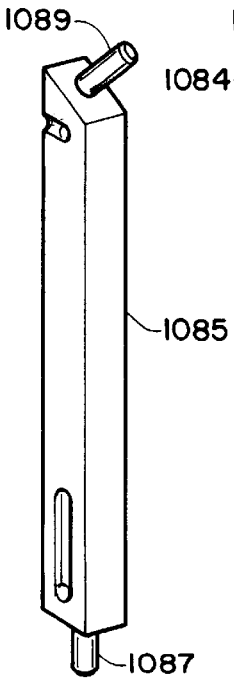
FIG. 28 is a greatly enlarged pictorial view of an upper display case frame member of FIG. 10, illustrating its detent slots and mounting pins.
Figure 29:
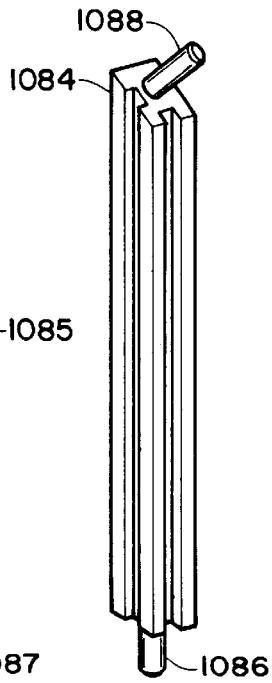
FIG. 29 is a greatly enlarged pictorial view of another upper display case frame member of FIG. 10, illustrating its slots and mounting pins.

The upper display case 1018 is substantially similar in construction to display case 418 that has been previously described. In this regard, the display case 1018 will not be described in greater detail except to mention that the support members are mounted to the window frame 1068 as opposed to the pedestal top 1016. That is, rather than having quick release pins, each of the frame members of the display case 1018, for example the frame members 1084 and 1085 includes a lower straight mounting pin, such as mounting pins 1086–1087 to facilitate securing the upper display case 1018 to the frame 1068 of the lower display case 1017 The frame members of the upper display case 1018 include angled mounting pins on their top portions to facilitate mounting the observation window 1074 to the frame members of the upper display case 1018. For example frame members 1084 and 1085 include window-mounting pins 1088 and 1089 respectively as best seen in FIGS. 28 and 29.

Considering now the low voltage lighting strip 1019 in greater detail with reference to FIG. 10, the low voltage lighting strip 1019 generally includes a lamp-mounting strip 1049 that is secured to the upper rear portion of the display case 1018 with a set of mounting clips. The mounting clips are not lose parts that need to be attached or detached during normal assembly and disassembly of the display case 1018.

The lamp mounting strip 1019 extends across substantially the entire lateral dimension of the display case 1018 and includes a plurality of lamp receiving sockets that are electrically coupled to a low voltage battery via an on-off switch (not shown) that enables the battery to be decoupled from the sockets when not in use. Each lamp receiving sockets is adapted to receive therein a low voltage lamp, such as a low voltage lamp 1066. The low voltage lamp 1066 may be either a low voltage halogen lamp or a low voltage xenon lamp depending upon the preference of the user. The low voltage battery is mounted to the backside of the lighting strip 1019 by a pair of battery clips (not shown).

While in the preferred embodiment of the present invention the lighting strip 1019 is described as being mounted within the upper display case 1018, those skilled in the art will understand that the lighting strip 1019 could also be mounted within the lower display case 1017. Therefore there is no intention of limiting the location of where the lighting strip is mounted as other mounting locations are contemplated within the true scope and spirit of the present invention.

While, particular preferred embodiments of the present invention have been disclosed, it is to be understood that various different modifications are possible and are contemplated within the true spirit and scope of the appended claims. More particularly because of the modular nature of the present invention different height and width variation are fully contemplated with different configuration. For example a double wide display case on a double wide pedestal top with a drop curtain attached to the collapsible pedestal base; two stacked double wide flat display cases disposed on a double wide pedestal top support from below by a pair of collapsible pedestal base units; a single angled display case spaced from a stacked pair of flat display cases disposed on a pedestal top supported from below by either a double wide collapsible pedestal base unit or a bridged pair of collapsible pedestal base units; a single angled display case spaced from a single flat display cases disposed on a pedestal top supported from below by either a double wide collapsible pedestal base unit or a bridged pair of collapsible pedestal base units; a double wide flat display case centered or offset on an extended pedestal top supported from below by either a double wide collapsible pedestal base unit or a bridged pair of collapsible pedestal base units; a double wide display case disposed on a doubled wide pedestal top supported from below by a pair of bridged pedestal base units; a double wide display case centrally disposed on an extended pedestal top supported from below by a bridged pair of collapsible pedestal base units, a single wide display case offset to either the right side or the left side of a double wide pedestal top supported from below by a double wide collapsible pedestal base unit or a bridged pair of collapsible base units; or stacked single wide display cases on a single wide pedestal top supported from below by a single wide collapsible pedestal base unit. There is no intention, therefore, of limitation as to the exact abstract or disclosure herein presented or described.

I claim:

1. A display kit comprising:

a collapsible pedestal base unit having a set of L-shaped elongated support legs collapsibly mounted together to form a hollow bar like structure in a collapsed state and a multi-legged stand like structure in a non collapsed state; and a pedestal top removably mounted to a top end of each individual one of said set of support legs;

at least one pair of collapsible members, each individual member being slidably mounted at its ends between two adjacent ones of said set of L-shaped support legs at their inner surface to allow said pair of collapsible members to be drawn together within said hollow bar like structure in said collapsed state and to expand into a cross-legged supporting structure between the two adjacent ones of said support legs to facilitate supporting them in an upright spaced apart position in said non collapsed state;

at least another pair of collapsible members, each individual another member being slidably mounted at its ends between another two adjacent ones of said set of L-shaped support legs at their inner surface to allow said at least another pair of collapsible members to be drawn together within said hollow bar like structure in said collapsed state and to expand into a cross-legged supporting structure between the another two adjacent ones of said support legs to facilitate supporting them in another upright spaced apart position in said non collapsed state.

2. A display kit according to claim 1 further comprising:

an intermediate shelf member disposed in a horizontal plane substantially parallel to said pedestal top and being supported from below by a set of shelf brackets disposed on said collapsible pedestal base unit.

3. A display kit according to claim 1, further comprising:

a storage container for storing and transporting said collapsible display table.

4. A method of assembling a display kit constructed in accordance with claim 1, comprising:

grasping said collapsible pedestal base unit in its collapsed state by all four-support legs;

pulling the support legs away from one another in a lateral direction only, until the lateral cross-legged members of said collapsible pedestal base unit are fully extended;

releasing one of the fully extended lateral pair of support legs to permit them to be pulled in a perpendicular direction from the grasped pair of support legs;

snapping the released support legs away from the grasped pair of support legs to a fully extended spaced apart position;

placing the substantially fully expanded base pedestal unit in a substantially secure upright position;

aligning a set of notched locators disposed on the underside of said pedestal top with a corresponding set of bottom pedestal locator members disposed on the upper distal ends of said support legs;

pressing said bottom pedestal locator members into said corresponding notched locators to establish a friction tight fit therebetween to secure said pedestal top to the top of said pedestal base unit; and pressing the free ends of said cross legged securing members into friction tight engagement with the interior wall of their opposing support legs to cam the pedestal base unit and the pedestal top into a ridged secure upright stable configuration suitable for supporting from below merchandise items.

5. A method of assembling a display kit in accordance with claim 4, further comprising:

placing an intermediate shelf into the interior of the pedestal base unit;

aligning the shelf in a horizontal plane substantially parallel to said pedestal top; and resting the shelf to rest on a set of shelf brackets projecting inwardly toward the interior of said pedestal base unit.

6. A display kit according to claim 1, further comprising:

a collapsible display case removably mounted to said pedestal top.

7. A display kit according to claim 6, wherein said collapsible display case has a trapezoidal configuration.

8. A display kit according to claim 6, wherein said collapsible display case has a box like configuration.

9. A display kit according to claim 6, further comprising;

a low voltage, battery operated lighting system mounted within said collapsible display case.

10. A collapsible display table according to claim 1, further comprising:

a pair of cross-legged securing members mounted at one of their distal ends only to said another two adjacent ones of said set of support legs to facilitate locking said pedestal base unit into a rigid configuration and to lock said pedestal top to said rigid pedestal base unit; and wherein said pair of cross-legged securing members are pivotally mounted together along their longitudinal axis at a point slightly offset from the center of their respective longitudinal dimensions.

11. A method of breaking down a display kit constructed in accordance with claim 10, comprising:

disengaging the pair of cross-legged securing members from a pair of support legs forming part of said collapsible pedestal base unit;

aligning the released the securing members in a position substantially parallel with said pair of support legs;

removing said pedestal top from engagement with a set of pedestal locators disposed on the top of said plurality of support legs; and collapsing said pedestal base unit by pulling its lateral support leg pairs towards one another and by pulling its longitudinal support leg pairs towards one another to permit the pedestal base unit to collapsed into a hollow elongated bar like configuration.

12. A display kit according to claim 1, further comprising:

a plurality of skirts removably mounted to said support leg to provide the collapsible pedestal base unit with a smooth stand like appearance.

13. A display kit according to claim 12, further comprising:

a storage container for storing and transporting said collapsible pedestal base unit and said plurality of skirts.

14. A display kit according to claim 1, further comprising:

a storage container for storing and transporting said collapsible pedestal base unit.

15. A display kit according to claim 1, further comprising:

another collapsible pedestal base unit, said another collapsible pedestal base unit being substantially the same as said collapsible pedestal base unit; and wherein said pedestal top is mounted between said collapsible pedestal base unit and said another collapsible base unit.

16. A display kit according to claim 15, further comprising:

a collapsible display case removably mounted to said pedestal top.

17. A display kit according to claim 16, wherein said collapsible display case has a lateral dimension substantially less than a lateral dimension of said pedestal top.

18. A display kit according to claim 16, wherein said collapsible display case is centrally disposed on said pedestal top.

19. A display kit according to claim 16, wherein said collapsible display case is offset to one side of said pedestal top.

20. A display kit according to claim 15, further comprising:

a pair of stackable merchandise display cases removably mounted to said pedestal top;

wherein a lower one of said pair of display cases has a box-like configuration and wherein an upper one of said pair of display cases has a trapezoidal configuration.

21. A display kit according to claim 1, wherein each one of said support legs include a height adjuster.

22. A display kit according to claim 1, further comprising:

a pair of stackable merchandise display cases removably mounted to said pedestal top;

wherein a lower one of said pair of display cases has a box-like configuration and wherein an upper one of said pair of display cases has a trapezoidal configuration.

23. A display kit according to claim 22, further comprising:

a low voltage, battery operated lighting system mounted within at least one of said pair of stackable merchandise display cases.

24. A display kit according to claim 1, wherein said set of elongated support legs includes a set of inner support legs sandwiched between a set of elongated outer support legs; and wherein said at least one pair of collapsible members are interconnected between adjacent ones of said set of inner support legs and outer support legs to facilitate supporting them in said upright spaced apart position in said non collapsed state and to facilitate collapsing them against one another in said collapsed state; and wherein said at least another pair of collapsible members are interconnected between another two adjacent ones of said set of inner support legs and said outer support legs to facilitate supporting them in another upright spaced apart position in the non collapsed state and to facilitate collapsing them against one another in the collapsed state.

25. A display kit comprising:

a collapsible display table;

said collapsible display table including:

a collapsible pedestal base unit having a set of elongated support legs;

at least one pair of collapsible members interconnected between two adjacent ones of said set of support legs to facilitate supporting them in an upright spaced apart position in one configuration and to facilitate collapsing them against one another in another configuration;

at least another pair of collapsible members interconnected between another two adjacent ones of said set of support legs to facilitate supporting them in another upright spaced apart position in the one configuration and to facilitate collapsing them against one another in the another configuration;

a pedestal top removably mounted to a top end of each individual one of said set of support legs;

a collapsible display case removably mounted to said pedestal top;

said pedestal top includes a front set of dowel holes and a rear set of dowel holes; and wherein said collapsible display cases includes at least two elongated access door receiving members, each of said access door receiving members being slotted throughout their entire longitudinal length on their front facing surface and having upper and lower detents on their inner facing surface;

each of said access door receiving members further including an elongated quick release pin disposed on one end thereof and a frame receiving mounting pin at the other end thereof;

each of said elongated quick release pins being of sufficient length and diameter to be received and held in an upright position in rear ones of said dowel holes until released under a sufficient pulling force on said access door receiving member to release said quick release pin from said front dowel hole;

wherein said display case further includes at least tow elongated glass receiving members, each of said glass receiving members being slotted throughout their entire longitudinal length on their rear facing surface and on their inner facing surface and having another elongated quick release pin disposed on one end thereof and another frame mounting pin at the other end thereof;

wherein said display case further includes a front sheet of glass mounted removably in the inner facing slots of said glass receiving members and supported from below by said pedestal top, a pair of side sheets of glass, each side sheet of glass being mounted in a front facing slot of one of said door receiving members and a rear facing slot on one of said glass receiving member;

wherein said display case further includes an access door having upper and lower detent receiving members to help facilitate removably mounting said access door between said at least two elongated access door receiving members; and wherein said display case further includes a framed window removably mounted on the frame receiving pins of said access door receiving member and the another frame receiving pins of said glass receiving members.

26. A display kit according to claim 25, wherein said access door is a lockable door.

27. A display kit according to claim 25, wherein said display table further includes a plurality of skirts removably mounted to said support legs to provide the display table with a smooth stand like appearance.

28. A display kit according to claim 27, further comprising:

a storage container for storing and transporting said collapsible display table.

* * * * *